US006776746B2

(12) United States Patent
Taylor

(10) Patent No.: US 6,776,746 B2
(45) Date of Patent: Aug. 17, 2004

(54) MULTI-USE PACKING STRUCTURE AND METHOD OF FORMING SAME

(75) Inventor: Mark Taylor, Martinsville, NJ (US)

(73) Assignee: Taylored Services Inc., Edison, NJ (US)

( * ) Notice: Subject to any disclaimer, the term of this patent is extended or adjusted under 35 U.S.C. 154(b) by 0 days.

(21) Appl. No.: 10/228,651

(22) Filed: Aug. 27, 2002

(65) Prior Publication Data

US 2004/0043881 A1 Mar. 4, 2004

(51) Int. Cl.[7] ..... B31B 1/14
(52) U.S. Cl. ..... 493/68; 493/69; 493/90
(58) Field of Search ..... 229/103.3, 108.1, 229/120.02; 493/68–70, 79, 80, 90, 901, 912

(56) References Cited

U.S. PATENT DOCUMENTS 3,101,880 A * 8/1963 Peterson ..... 229/120.012
4,058,206 A * 11/1977 Morse et al. ..... 229/241
4,159,797 A * 7/1979 Roozee ..... 229/120.02
4,174,041 A * 11/1979 Turner ..... 229/229
4,265,393 A * 5/1981 Orchard ..... 229/103.3
4,560,102 A * 12/1985 Dlugopolski ..... 229/103.3
4,750,609 A * 6/1988 Felis ..... 206/1.7
4,871,345 A * 10/1989 Wosaba et al. ..... 493/59
5,002,221 A * 3/1991 Ragan ..... 229/120
5,156,331 A * 10/1992 Pirre ..... 229/223
6,155,477 A * 12/2000 Herrera et al. ..... 229/103
6,471,118 B1 * 10/2002 Chevalier ..... 229/103.3
6,616,585 B2 * 9/2003 Okamoto ..... 493/51

* cited by examiner

*Primary Examiner*—Eugene L Kim
(74) *Attorney, Agent, or Firm*—Lerner, David, Littenberg, Krumholz & Mentlik, LLP

(57) ABSTRACT

A blank is provided for forming either a packaging structure of a relatively large size or a greater number of smaller sized packaging structures. The blank is provided with predetermined fold lines. Folding the blank along one series of fold lines forms the relatively large packaging structure. Separating the blank along one or more fold lines into plural blanks and folding the plural blanks along another series of fold lines forms multiple smaller packaging structures. A similar technique forms one large or multiple smaller covers for the packaging structures.

9 Claims, 19 Drawing Sheets

MULTI-USE PACKING STRUCTURE AND METHOD OF FORMING SAME

BACKGROUND OF THE INVENTION

The present invention relates to packaging structures. More particularly, the present invention relates to blanks for forming packaging structures and covers that may be subjected to a one-way conversion from a packaging structure or cover of relatively large size to a greater number of smaller sized packaging structures or covers. The present invention is also directed to methods for forming such packaging structures and covers, and systems for combining them with one another.

Protective packaging structures are often used when an article to be transported requires protection from physical shock, dust, dirt or other contaminants. For example, when shipping articles that may be relatively fragile, it is often desirable to package the article inside a box to protect the article from physical impacts that may occur during loading, transit or unloading. In addition, when shipping sensitive articles, such as computer components, it is often desirable to protect those articles from elements such as dust or moisture.

Protective packaging structures may also be used for the simple purpose of storing various objects, even if no transit is expected. For example, many people find it convenient to store off-season clothing or various other items in locations throughout their homes. Popular locations include closets, basements, or under beds. Packaging structures may be constructed and marketed to serve these purposes. For example, packaging structures suitable for under-the-bed storage use are generally long, wide and low, so they may fit under a standard bed while still offering valuable storage capacity.

Packaging structures suitable for each of these purposes have been known in the art for many years. These packaging structures may be formed from cardboard, plastic, metal, paperboard, corrugated cardboard, or the like. Additionally, these materials may be coated or impregnated with various other substances in order to improve certain qualities such as strength, protection of underlying print or images, or to repel moisture. For example, cardboard boxes are often printed upon with ink and then covered with a varnish. The varnish serves to protect the print, strengthen the structure, and repel moisture.

In accordance with techniques which are generally known in the packaging art, a single panel or blank of material may be cut and folded along predetermined lines to yield packaging structures having the desired size and structural features for a particular application. Generally, such blanks are essentially planar until folded into the packaging structure shape. This efficient design enables the structures to be shipped in a flat configuration, while being readily converted to folded configuration prior to their intended use.

Packaging structures in accordance with the prior art have been designed such that a given blank forms a single packaging structure size. Therefore, if the end user requires multiple-size packaging structures, that user must purchase blanks of each corresponding size required, the end result of which is that the end user must purchase and store blanks corresponding to each size packaging structure intended to be used. This not only requires sufficient space to store such blanks, but requires sufficient forethought by the end user so that a blank of the correct size is available when needed.

Therefore, there exists a need for packaging structure blanks configured such that they may yield multiple size packaging structures. Preferably, such blanks will be formed so that they may be readily converted to folded configurations of multiple sizes quickly and efficiently without sacrificing the strength of the packaging structure.

SUMMARY OF THE INVENTION

The present invention addresses these needs.

One aspect of the present invention provides a blank for forming packages. The blank includes a substantially rigid panel having a pair of spaced side edges and a pair of spaced end edges oriented transverse to the side edges. A first pair of fold lines is spaced from the side edges to define respective folding side portions separated by a remaining portion of the panel. A second pair of fold lines is spaced from the end edges of the panel and oriented transverse to the first pair of fold lines. The second pair of fold lines defines respective folding end portions. The first and second pairs of fold lines delimit a center portion of the panel. A pair of auxiliary fold lines extending between the end edges in the remaining portion of the panel is oriented transverse to the second pair of fold lines. Finally, an intermediate fold line extends between the end edges in the remaining portion of the panel. The intermediate fold line is oriented transverse to the second pair of fold lines and is disposed between the pair of auxiliary fold lines to define a first auxiliary folding portion between one of the pair of auxiliary fold lines and the intermediate fold line and a second auxiliary folding portion between another of the pair of auxiliary fold lines and the intermediate fold line.

The panel has an unfolded condition in which the folding side portions and folding end portions are substantially coplanar with the center portion of the panel, and a second condition in which the folding side portions and folding end portions are folded transverse to the center portion of the panel to define a first packaging structure. The panel also has a third condition in which the panel is separated along the intermediate fold line into two subpanels. Each of the subpanels has one of the folding side portions, one of the auxiliary folding portions, and the folding end portions delimiting a main portion of the subpanel. Further, each of the subpanels is foldable into a condition in which the one folding side portion, the one auxiliary folding portion, and the folding end portions are folded transverse to the main portion of the subpanel whereby the panel in the third condition defines a pair of packaging structures.

In one embodiment, the blank may also contain a first additional fold line in each of the folding end portions which defines proximal and distal end segments in each of the folding end portions. In the second condition, each of the folding end portions of the panel are folded along the first additional fold lines so that the distal end segment in each of the folding end portions confronts the proximal end segment and is positioned between the folding side portions.

The blank may also include means for interconnecting the folding side portions and folding end portions when the panel is in the second condition. The interconnecting means may include a flap formed at each end of each of the folding side portions which is foldable relative to the folding side portions. The flaps may be interposed between the proximal end segment and the distal end segment of the folding end portions when the panel is in the second condition.

In another embodiment, the blank may also include means for interconnecting the folding side portions and folding auxiliary portions with the folding end portions in the third condition of the panel. Such interconnecting means may include a flap formed at each end of each of the folding side portions and a flap formed at each end of each of the auxiliary folding portions. The flaps may be interposed between the proximal end segments and distal end segments of the folding end portions when the panel is in the third condition. The flaps may be joined to the folding side portions, the auxiliary folding portions and the folding end portions in the unfolded condition of the panel but not joined to the folding end portions in the third condition of the panel.

In a further embodiment, the blank may also include means for securing the panel in the second condition. Such means may include a patterned cut in each of the folding end portions defining at least one tab. Each tab may project from one of the end edges in a direction away from the center portion of the panel. At least one slot may be formed along each of the second pair of fold lines. Each of the tabs may be engageable in one of the slots when the panel is in the second condition.

In still another embodiment, a blank for folding packages includes a substantially rigid panel having a pair of spaced side edges and a pair of spaced end edges oriented transverse to the side edges. A first pair of fold lines spaced from the side edges of the panel define respective side portions separated by an intermediate portion of the panel. A second pair of fold lines spaced from the end edges of the panel and oriented transverse to the first pair of fold lines define respective folding end portions. The first and second pairs of fold lines delimit a center portion of the panel. A first pair of auxiliary fold lines extends between the end edges in the intermediate portion of the panel. The first pair of auxiliary fold lines is oriented transverse to the second pair of fold lines and is separated by a remaining portion of the panel. A second pair of auxiliary fold lines extends between the end edges in the remaining portion of the panel and is oriented transverse to the second pair of fold lines. A first intermediate fold line extends between the end edges of the panel and is oriented transverse to the second pair of fold lines. The first intermediate fold line is disposed between one of the first pair of auxiliary fold lines and a nearest one of the second pair of auxiliary fold lines to define a first auxiliary folding portion between the one of the first pair of auxiliary fold lines and the first intermediate fold line and a second auxiliary folding portion between the nearest one of the second pair of auxiliary fold lines and the first intermediate fold line. A second intermediate fold line extends between the end edges of the panel end is oriented transverse to the second pair of fold lines. The second intermediate fold line is disposed between another of the first pair of auxiliary fold lines and another of the second pair of auxiliary fold lines to define a third auxiliary folding portion between the another of the second pair of auxiliary fold lines and the second intermediate fold line and a fourth auxiliary folding portion between the another of the first pair of auxiliary fold lines and the second intermediate fold line.

The panel has an unfolded condition in which the center portion of the panel is substantially planar and the folding side portions and folding end portions are substantially coplanar with the center portion. The panel has a second condition in which the folding side portions and folding end portions are folded transverse to the center portion of the panel to define a first packaging structure. The panel also has a third condition in which the panel is separated along the first intermediate fold line into a first subpanel and a second subpanel.

The first subpanel has one of the folding side portions, the first auxiliary folding portion, and the folding end portions delimiting a main portion of the first subpanel. The first subpanel is foldable into a condition in which the one of the folding side portions, the first auxiliary folding portion and the folding end portions are folded transverse to the main portion of the first subpanel to define a first packaging structure.

The second subpanel has the second auxiliary folding portion, another of the folding side portions and the folding end portions delimiting a main portion of the second subpanel. The second subpanel is foldable into a condition in which the another folding side portion, the second auxiliary folding portion, and the folding end portions are folded transverse to the main portion of the second subpanel to define a second packaging structure. The packaging structures may be of equal or different sizes.

The panel may also have a fourth condition in which the second subpanel is separated along the second intermediate fold line into a third subpanel and a fourth subpanel. The third subpanel has the second auxiliary folding side portion, the third auxiliary folding side portion, and the folding end portions delimiting a main portion of the third subpanel. The third subpanel is foldable into a condition in which the second auxiliary folding side portion, the third auxiliary folding side portion, and the folding end portions are folded transverse to the main portion of the third subpanel to define a first subsidiary packaging structure.

The fourth subpanel has the fourth auxiliary folding side portion, the another of the folding side portions and the folding end portions delimiting a main portion of the fourth subpanel. The fourth subpanel is foldable into a condition in which the fourth auxiliary folding side portion, the another of the folding side portions, and the folding end portions are folded transverse to the main portion of the fourth subpanel to define a second subsidiary packaging structure.

In another aspect of the present invention, a system for forming packaging structures includes a substantially rigid panel having a pair of spaced side edges and a pair of spaced end edges oriented transverse to the side edges. A first pair of fold lines spaced from the side edges of the panel define respective side portions separated by an intermediate portion of the panel. A second pair of fold lines spaced from the end edges of the panel and oriented transverse to the first pair of fold lines define respective folding end portions. The first and second pairs of fold lines delimit a center portion of the panel. A first pair of auxiliary fold lines extends between the end edges in the intermediate portion of the panel. The first pair of auxiliary fold lines is oriented transverse to the second pair of fold lines and is separated by a remaining portion of the panel. A second pair of auxiliary fold lines extends between the end edges in the remaining portion of the panel and is oriented transverse to the second pair of fold lines. An intermediate fold line extends between the end edges of the panel and is oriented transverse to the second pair of fold lines. The intermediate fold line is disposed between the pair of auxiliary fold lines to define a first auxiliary folding portion between the one of the pair of auxiliary fold lines and the intermediate fold line and a second auxiliary folding portion between another of the pair of auxiliary fold lines and the intermediate fold line. The system also includes a cover.

The panel has an unfolded condition in which the center portion of the panel is substantially planar and the folding side portions and folding end portions are substantially coplanar with the center portion. The panel has a second condition in which the folding side portions and folding end portions are folded transverse to the center portion of the panel to define a first packaging structure having an open top. The panel also has a third condition in which the panel is separated along the first intermediate fold line into a first subpanel and a second subpanel.

Each of the subpanels has one of the folding side portions, one of the auxiliary folding portions, and the folding end portions delimiting a main portion of the subpanel. Each of the subpanels is foldable into a condition in which one folding side portion, one auxiliary folding portion and the folding end portions are folded transverse to the main portion of the subpanel to define a packaging structure having an open top.

The cover may be adapted to enclose the open top of the first packaging structure when the panel is placed in the second condition.

In still another embodiment, the cover may be formed from a second panel having at least one fold line defining a first section and a second section. The second panel has a first condition in which the first section is attached to the second section. The panel has a second condition in which the first section is separated from the second section along the at least one fold line. The first section is foldable to define a first sub-cover adapted to enclose the open top of one of the pair of packaging structures when the panel is placed in the third condition and the second section is foldable to define a second sub-cover adapted to enclose the open top of the other of the pair of packaging structures when the panel is placed in the third condition.

Yet another aspect of the present invention provides methods for forming a plurality of packaging structures. One method includes providing a substantially rigid panel having a pair of spaced side edges and a pair of spaced end edges oriented transverse to the side edges; a first pair of fold line spaced from the side edges of the panel to define respective folding side portions separated by a remaining portion of the panel; and a second pair of fold lines spaced from the end edges of the panel and oriented transverse to the first pair of fold lines. The second pair of fold lines defines respective folding end portions and the first and second pairs of fold lines delimit a center portion of the panel. The panel is also provided with a pair of auxiliary fold lines extending between the end edges in the remaining portion of the panel and oriented transverse to the second pair of fold lines, and an intermediate fold line extending between the end edges in the remaining portion of the panel and oriented transverse to the second pair of fold lines. The intermediate fold line is disposed between the pair of auxiliary fold lines to define a first auxiliary folding portion between one of the pair of auxiliary fold lines and the intermediate fold line and a second auxiliary folding portion between another of the pair of auxiliary fold lines and the intermediate fold line.

The panel may be separated along the intermediate fold line into a first subpanel and a second subpanel. Each of the subpanels has one of the folding side portions, one of the auxiliary folding portions, and the folding end portions delimiting a main portion of the subpanel. The folding side portion, the auxiliary folding portion, and the folding end portions of the first subpanel may be folded transverse to the main portion of the first subpanel to define a first packaging structure, and the folding side portion, the auxiliary folding portion, and the folding end portions of the second subpanel may be folded transverse to the main portion of the second subpanel to define a second packaging structure.

Embodiments of the method may include providing a cover for each packaging structure and assembling the cover to the packaging structure to enclose the packaging structure. The covers may be provided as a second panel having a fold line defining a first section and a second section. The second panel may be separated along the fold line to define a first sub-cover and a second sub-cover. The first sub-cover may be assembled to the first packaging structure to enclose the first packaging structure and the second sub-cover may be assembled to the second packaging structure to enclose the second packaging structure.

The covers may also be provided as a rigid second panel having a pair of spaced side edges and a pair of spaced end edges oriented transverse to the side edges, a first pair of fold lines spaced from the side edges of the second panel to define respective folding side portions separated by a remaining portion of the second panel, and a second pair of fold lines spaced from the end edges of the second panel and oriented transverse to the first pair of fold lines. The second pair of fold lines define respective folding end portions and the first and second pairs of fold lines delimit a center portion of the second panel. The second panel may optionally include a pair of auxiliary fold lines extending between the end edges in the remaining portion of the second panel and oriented transverse to the second pair of fold lines, and an intermediate fold line extending between the end edges in the remaining portion of the second panel and oriented transverse to the second pair of fold lines. The intermediate fold line is disposed between the pair of auxiliary fold lines to define a first auxiliary folding portion between one of the pair of auxiliary fold lines and the intermediate fold line and a second auxiliary folding portion between another of the pair of auxiliary fold lines and the intermediate fold line.

The second panel may be separated along the intermediate fold line into a first cover sub-panel and a second cover sub-panel. The first cover sub-panel may be folded into a first sub-cover and the second cover subpanel may be folded into a second sub-cover. The first sub-cover may be assembled on the first packaging structure to enclose the open top of the first packaging structure, and the second sub-cover may be assembled on the second packaging structure to enclose the open top of the second packaging structure.

In other embodiments, the rigid panel provided in the method of forming a plurality of packaging structures may also include providing cutouts within the second panel. The cutouts provide areas where leverage may be obtained by the digits of the human hand upon folding of the first cover sub-panel into a first cover and folding of the second cover sub-panel into a second cover.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION

Figure 1:
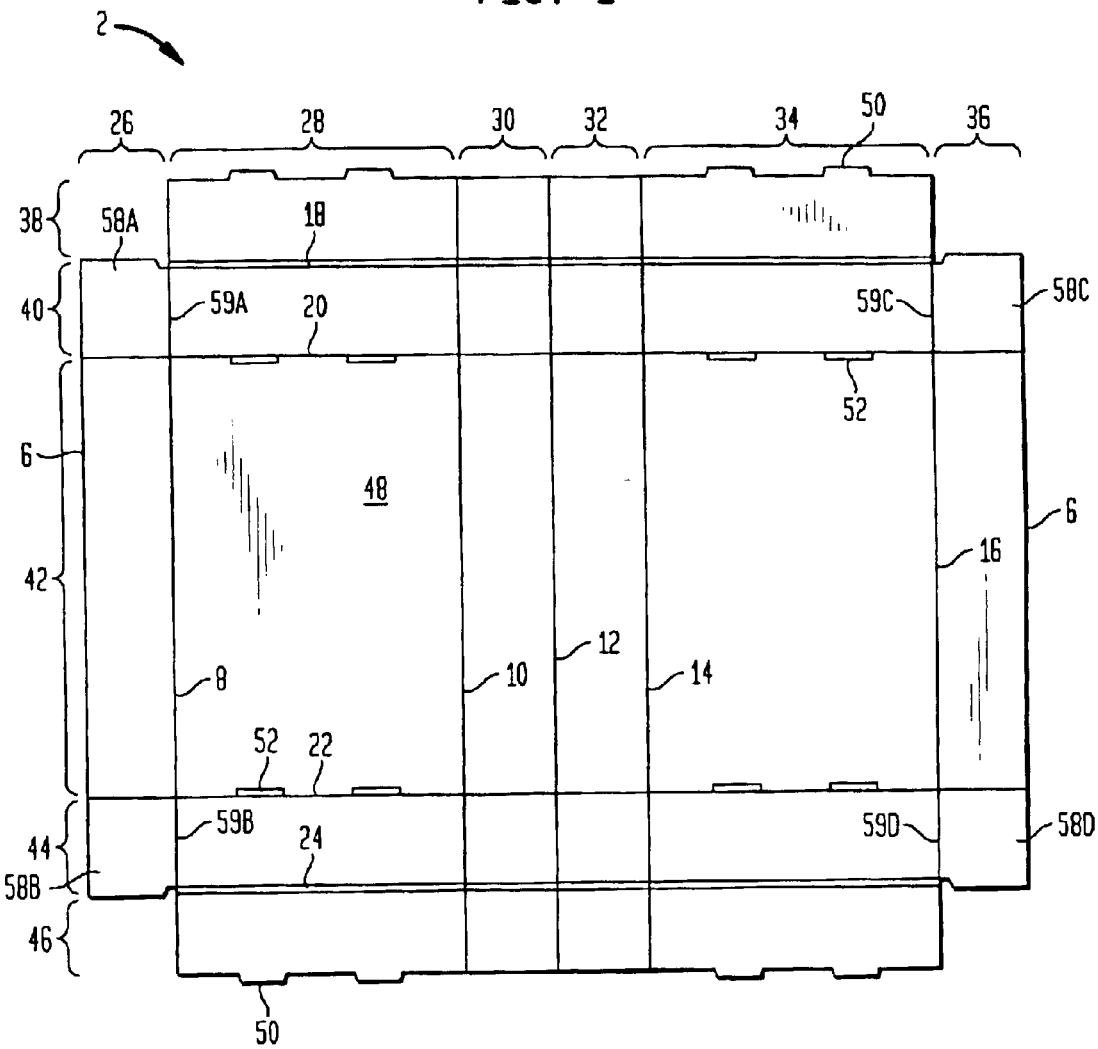
FIG. 1 is a plan view of a blank for forming a packaging structure in accordance with one embodiment of the present invention.

In the following are described multiple embodiments of the packaging structures and covers of the present invention. In describing the preferred embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose. In this regard, the lines depicted in FIG. 1, as well as in the other figures depicting blanks herein, represent lines along which the blank is creased, crimped, embossed, perforated, scored, cut/scored or otherwise weakened so as facilitate the process of folding such blank into the final shape of the packaging structure in accordance with the embodiments of the present invention.

Packaging structures disclosed herein may be constructed from any substantially rigid, lightweight foldable material, such as cardboard, plastic, metal, paperboard, corrugated cardboard, or the like. Additionally, these materials may be coated or impregnated with various other substances, such as varnish, in order to improve certain qualities such as strength, protection of underlying print or images, or to repel moisture.

Referring to the figures, FIG. 1 shows a blank 2 for forming packaging structures in accordance with one embodiment of the present invention. Blank 2 includes a continuous border 6 completely circumventing its periphery. When positioned in the orientation shown in FIG. 1, blank 2 further includes substantially parallel vertical fold lines 8, 10, 12, 14 and 16, and substantially parallel horizontal fold lines 18, 20, 22 and 24. The vertical fold lines 8, 10, 12, 14 and 16 preferably are perpendicular to the horizontal fold lines 18, 20, 22 and 24.

Each of fold lines 8, 10, 12, 14, 16, 20 and 22 are single fold lines. Fold lines 18 and 24, however, are double fold lines. As will become more apparent when viewed in accordance with the present invention's folding procedure described hereinafter, single fold lines are typically utilized to make a fold of approximately 90 degrees. Double fold lines are used when the fold is approximately 180 degrees. In practice, a double fold line is essentially two single fold lines running parallel to each other and spaced apart a distance approximately equal to the thickness of the material from which the blank is formed, such that each single fold line is folded approximately 90 degrees, for a combined total of approximately 180 degrees.

Fold lines 8, 10, 12, 14 and 16 and continuous border 6 of blank 2 define vertical folding panels 26, 28, 30, 32, 34 and 36. As shown in FIG. 1, vertical folding panel 26 lies between portions of continuous border 6 and vertical fold line 8; vertical folding panel 28 lies between vertical fold lines 8 and 10; vertical folding panel 30 lies between vertical fold lines 10 and 12; vertical folding panel 32 lies between vertical fold lines 12 and 14; vertical panel 34 lies between vertical fold lines 14 and 16; and vertical panel 36 lies between vertical fold line 16 and portions of continuous border 6.

Vertical folding panel 26 has a pair of flaps 58A and 58B formed at its extremities. Flap 58A is defined by a score line 59A formed substantially, but not entirely, through the thickness of blank 2. Similarly, flap 58B is defined by a score line 59B formed substantially, but not entirely, through the thickness of blank 2. Vertical folding panel 36 includes similar flaps 58C and 58D formed at its extremities, flap 58C being defined by score line 59C and flap 58D being defined by score line 59D. Both of score lines 59C and 59D are formed substantially, but not entirely, through the thickness of blank 2. In a preferred embodiment, score lines 59A–D remain connected during all phases of processing, packaging and transporting of blank 2. These score lines may be intentionally broken by the user with little effort, such that flaps 58A–D are free to rotate independently of the portion of blank 2 to which they formerly were attached.

Blank 2 also includes horizontal folding panels 38, 40, 42, 44 and 46. As shown in FIG. 1, horizontal folding panel 38 lies between a portion of continuous border 6 and horizontal fold line 18; horizontal folding panel 40 lies between horizontal fold lines 18 and 20; horizontal folding panel 42 lies between horizontal fold lines 20 and 22; horizontal folding panel 44 lies between horizontal fold lines 22 and 24; and horizontal folding panel 46 lies between horizontal fold line 24 and a portion of continuous border 6.

Figure 2:
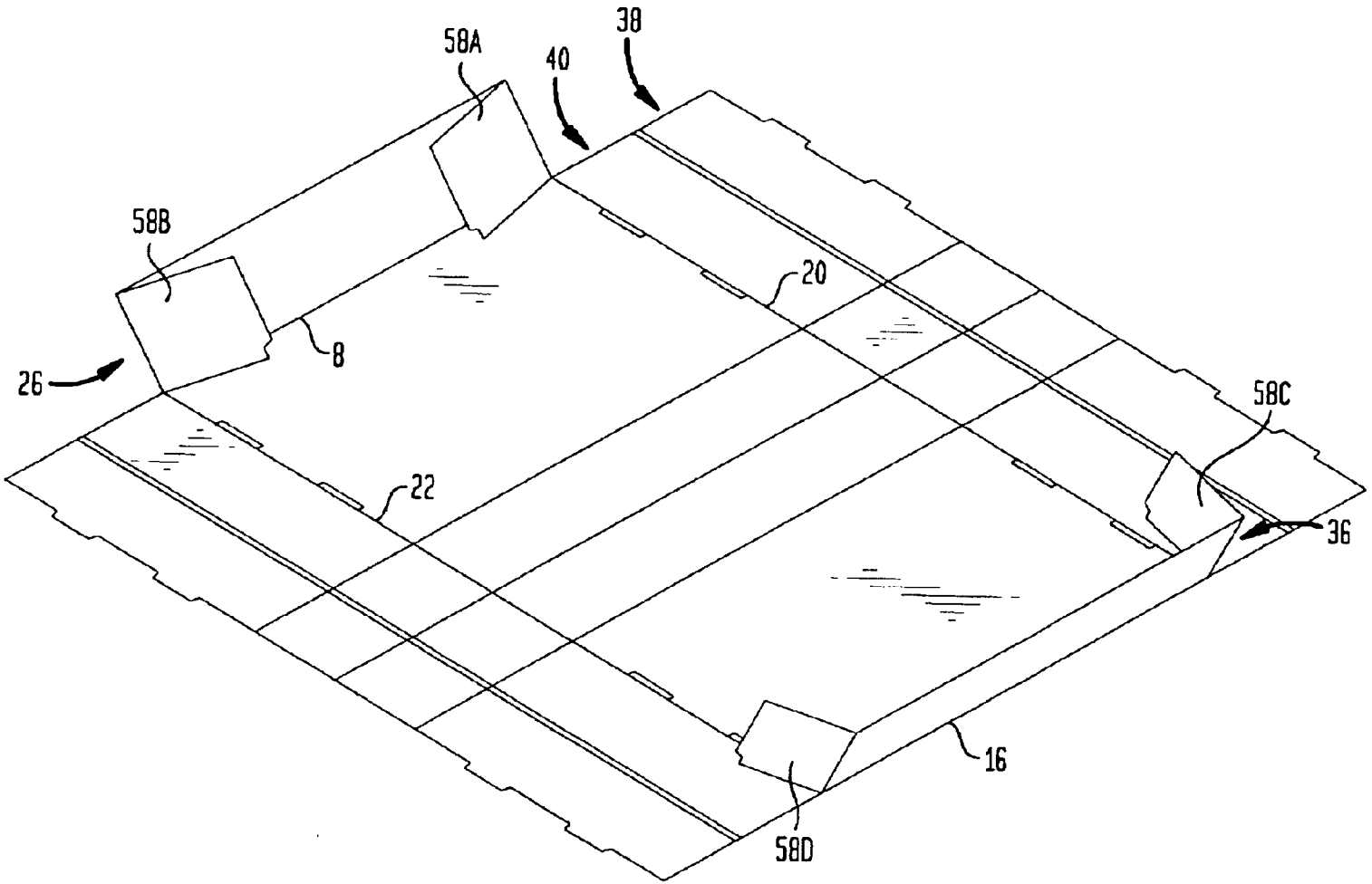
FIGS. 2–4 are perspective views showing a technique for folding the blank of FIG. 1 into a packaging structure.
Figure 3:
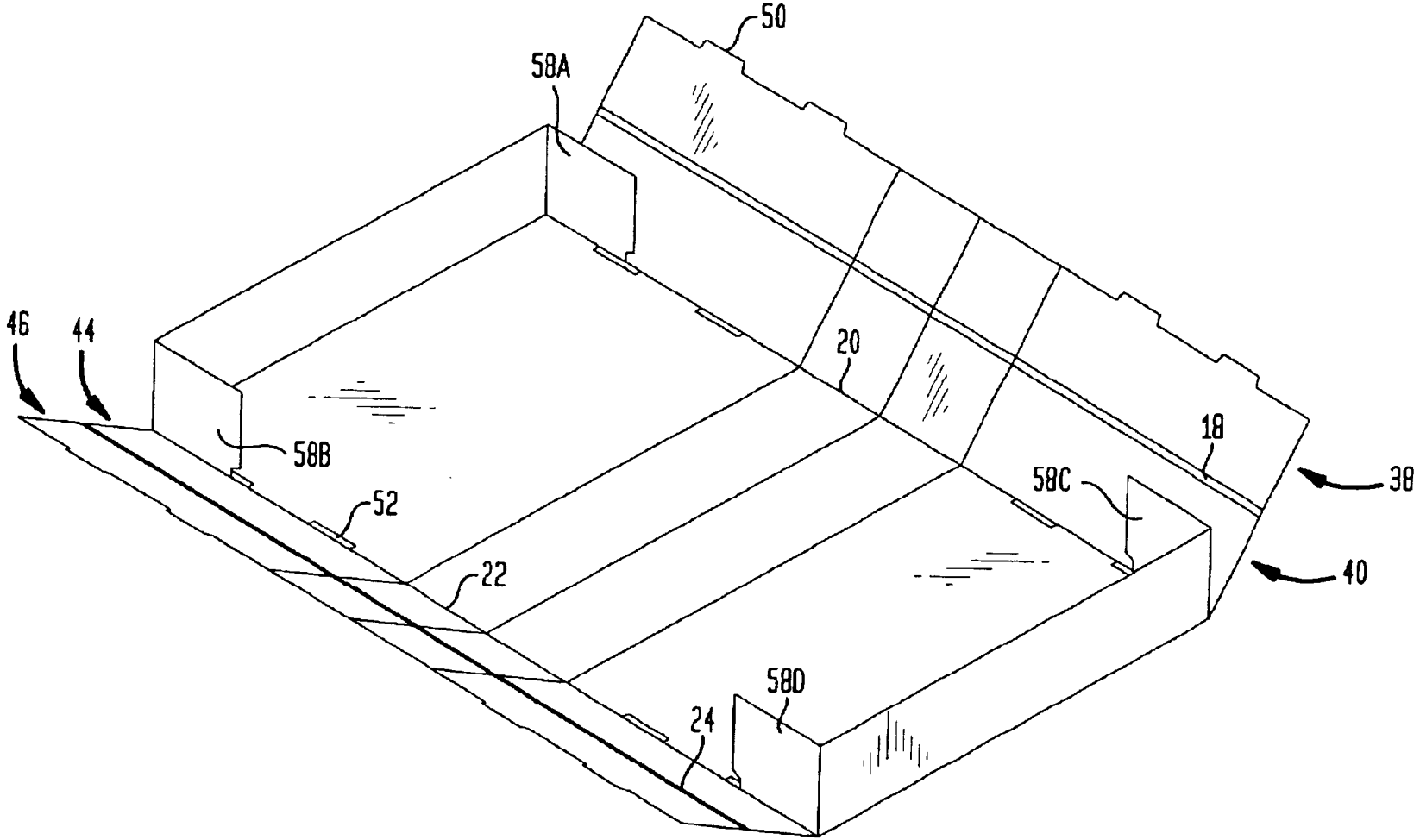
Figure 4:
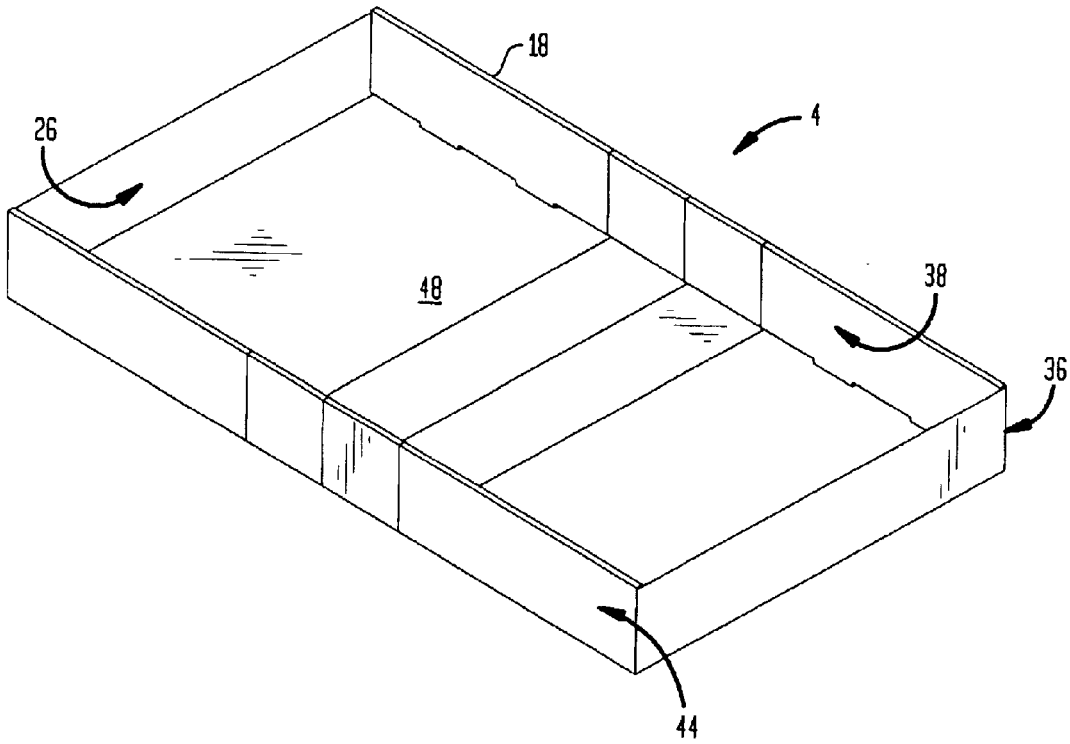

In the boundary defined by vertical fold lines 8 and 16 and horizontal fold lines 20 and 22 lies large panel 48. Large panel 48 constitutes the floor of the packaging structure folded as shown in FIGS. 2–4. As will be appreciated from the explanation of the procedure depicted in FIGS. 2–4, vertical fold lines 10, 12 and 14 are not folded in this procedure. Depending on the weight of the load to be placed in the folded packaging structure, additional reinforcement of these fold lines 10, 12 and 14, such as by applying packaging tape (not shown), may be required to prevent accidental bursting at these weakened locations. In preferred embodiments, such reinforcement is not necessary as the fold lines are not weakened to an extent that would require such attention.

Along the continuous border 6 and protruding therefrom, there are included tab members 50 in preferred embodiments of the present invention. In addition, if tab members 50 are included, fold lines 20 and 22 each will include slots 52 for receiving the tab members 50 when the packaging structures formable from blank 2 are fully folded. The interlocking of the tab members 50 within the slots 52 assists in maintaining the structural rigidity and folded condition of the packaging structures.

In one method, depicted in FIGS. 2–4, blank 2 may be folded to form a single large packaging structure 4. As a first step, blank 2 may be placed in the intermediate folded position shown in FIG. 2. This is accomplished by first folding flaps 58A and 58C upwardly along fold line 20 and by folding flaps 58B and 58D upwardly along fold line 22. Thereafter, vertical folding panels 26 and 36 are folded upwardly along vertical fold lines 8 and 16, respectively. As shown in FIG. 3, horizontal folding panels 38 and 40 are then folded in tandem upwardly along horizontal folding line 20 such that flaps 58A and 58C lie interior of horizontal folding panel 40. Likewise, horizontal folding panels 46 and 44 are folded upwardly, in tandem, along fold line 22. Horizontal folding panel 38 is then folded along fold line 18 over flaps 58A and 58C such that these flaps are interposed between horizontal folding panels 38 and 40. Horizontal folding panel 46 is then folded along fold line 24 over flaps 58B and 58D such that these flaps are interposed between horizontal folding panels 44 and 46. If the continuous border 6 is provided with tab members 50 and horizontal fold lines 20 and 22 are provided with slots 52, then the tab members 50 are inserted into the slots 52 to retain the packaging structure 4 in this subsequent folded condition. It will be appreciated that when placing the packaging structure 4 in such a configuration, vertical folding panels 26 and 36 necessarily will be retained in a position nearly perpendicular to the plane of panel 48. A packaging structure 4 folded in accordance with this procedure is shown in FIG. 4.

When folded in accordance with the preceding procedure, it will be appreciated that packaging structure 4 will have side walls of either double or single thickness. Specifically, the side walls formed by vertical folding panels 26 and 36 will be single walled, while the side wall formed by horizontal folding panels 38 and 40 will be double walled, as will the sidewall formed in horizontal folding panels 44 and 46.

Although the packaging structure 4 has been described with tab members 58A–D, tabs 50 and slots 52 providing means to retain its folded configuration, it will be appreciated that different means may be employed for this task. Such different means may include the use of tape, staples or glue. Although the remainder of this specification will continue with reference to tab members 58A–D, tabs 50 and slots 52 for the sake of clarity, it should be understood that the aforementioned different means or any combination of different means, may be employed.

Figure 5:
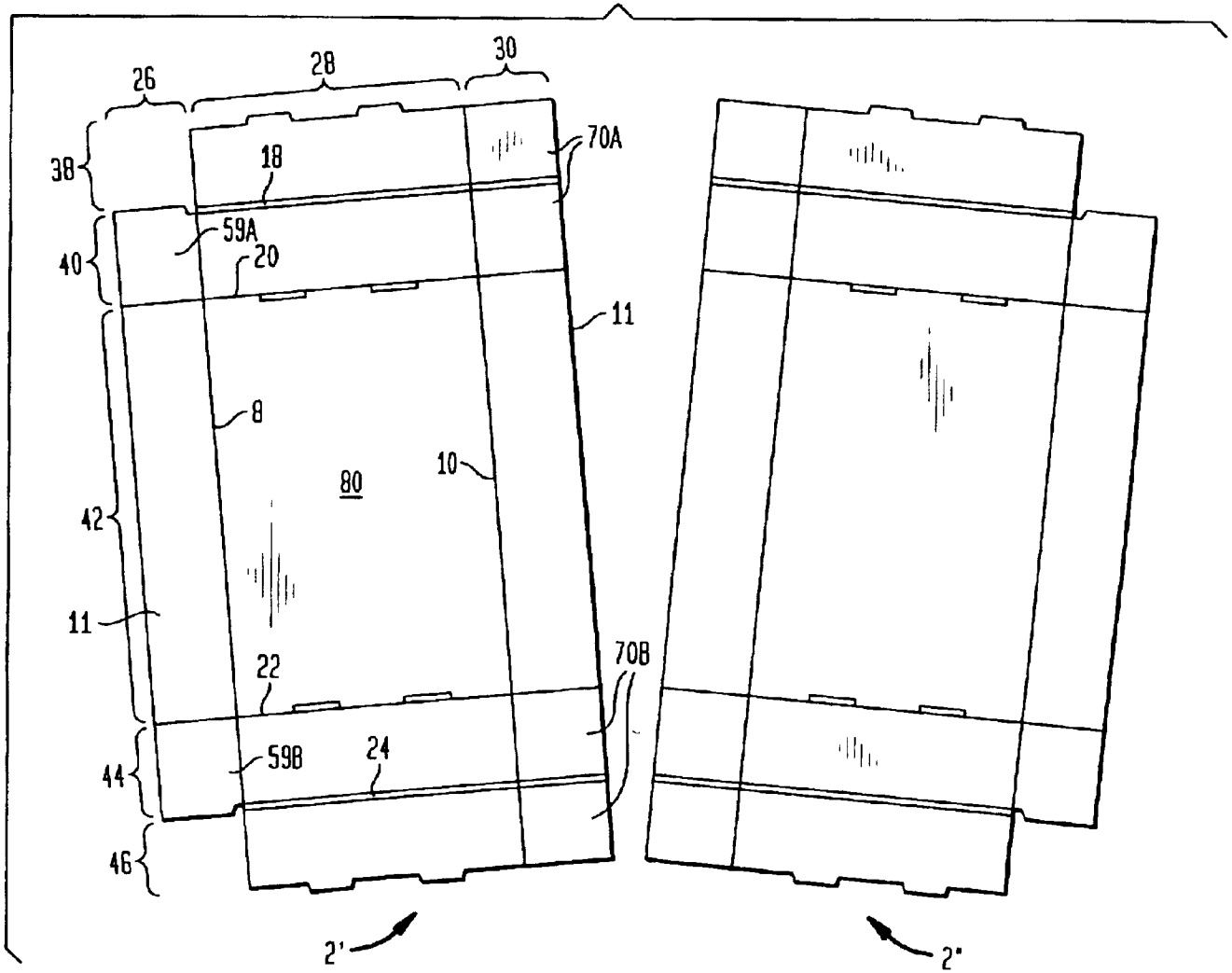
FIG. 5 is a plan view showing the separation of the blank of FIG. 1 into two separate blanks.

Rather than folding blank 2 to form a single large packaging structure 4 as described above, blank 2 may be torn, cut or otherwise separated along fold line 12 into two minor blanks 2' and 2", as shown in FIG. 5. The end result of this separation is that blank 2 may be used to form two smaller packaging structures 7 (see FIG. 6). Using minor blank 2' as an example, the following detailed description illustrates the structure of minor blank 2' and its formation into a packaging structure 7 which is smaller than packaging structure 4.

Blank 2' includes a continuous border 11 completely circumventing its periphery. Border 11 is defined by portions of border 6 and fold line 12 of blank 2. When positioned in the orientation shown in FIG. 5, blank 2' further includes vertical fold lines 8 and 10, and horizontal fold lines 18, 20, 22 and 24.

As previously described, each of the vertical fold lines 8 and 10 are single fold lines, as are the horizontal fold lines 20 and 22. Horizontal fold lines 18 and 24, meanwhile, are double fold lines. As shown in FIG. 5, these fold lines define in blank 2' vertical folding panels 26, 28 and 30, and horizontal folding panels 38, 40, 42, 44 and 46.

Vertical folding panel 26 has flaps 58A and 58B formed at its extremities. Vertical folding panel 30, on the other hand, has a pair of flaps 70A and 70B which must be created by the end user. The process of creating such flaps will be described hereinafter.

Figure 7:
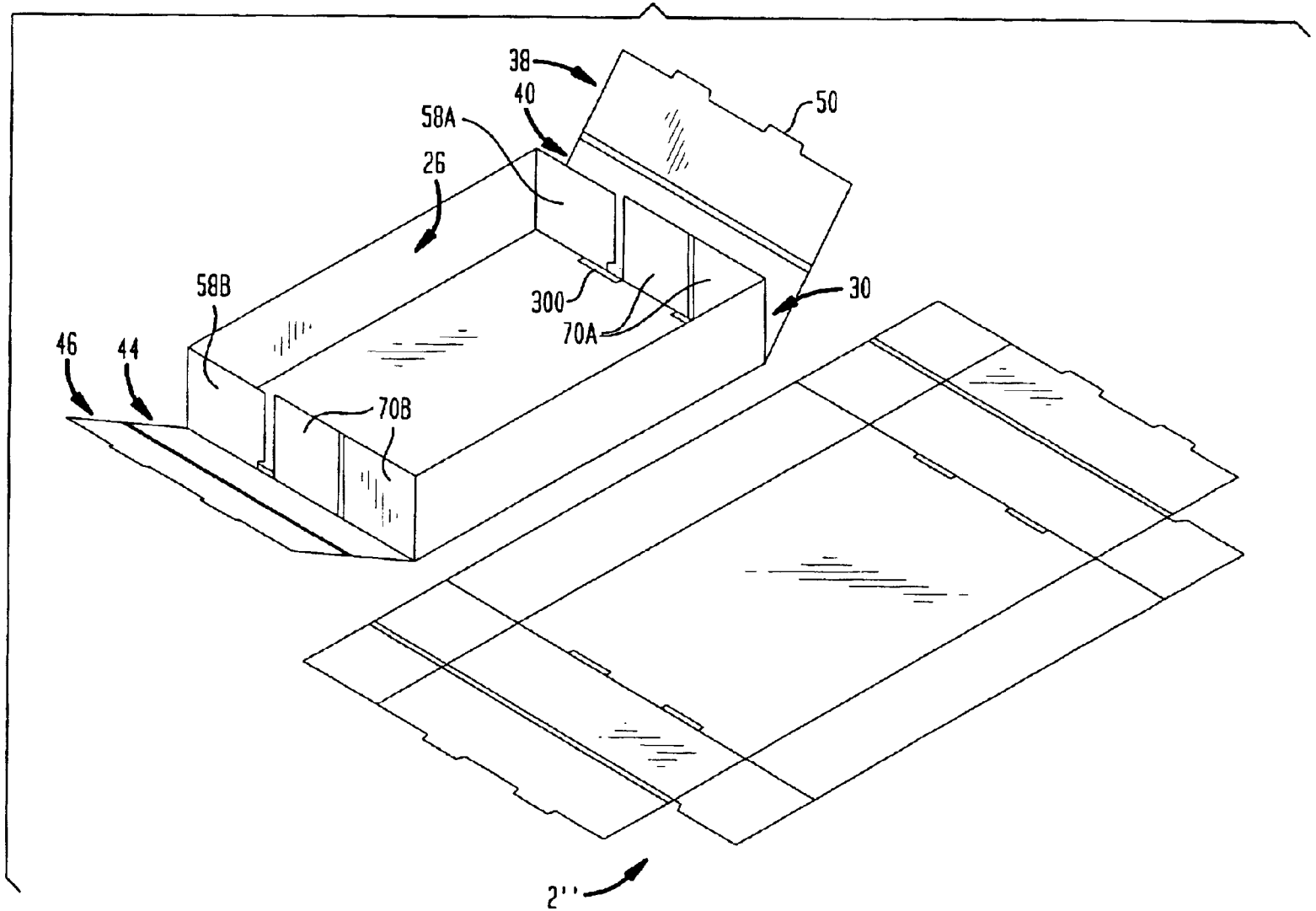
Figure 8:
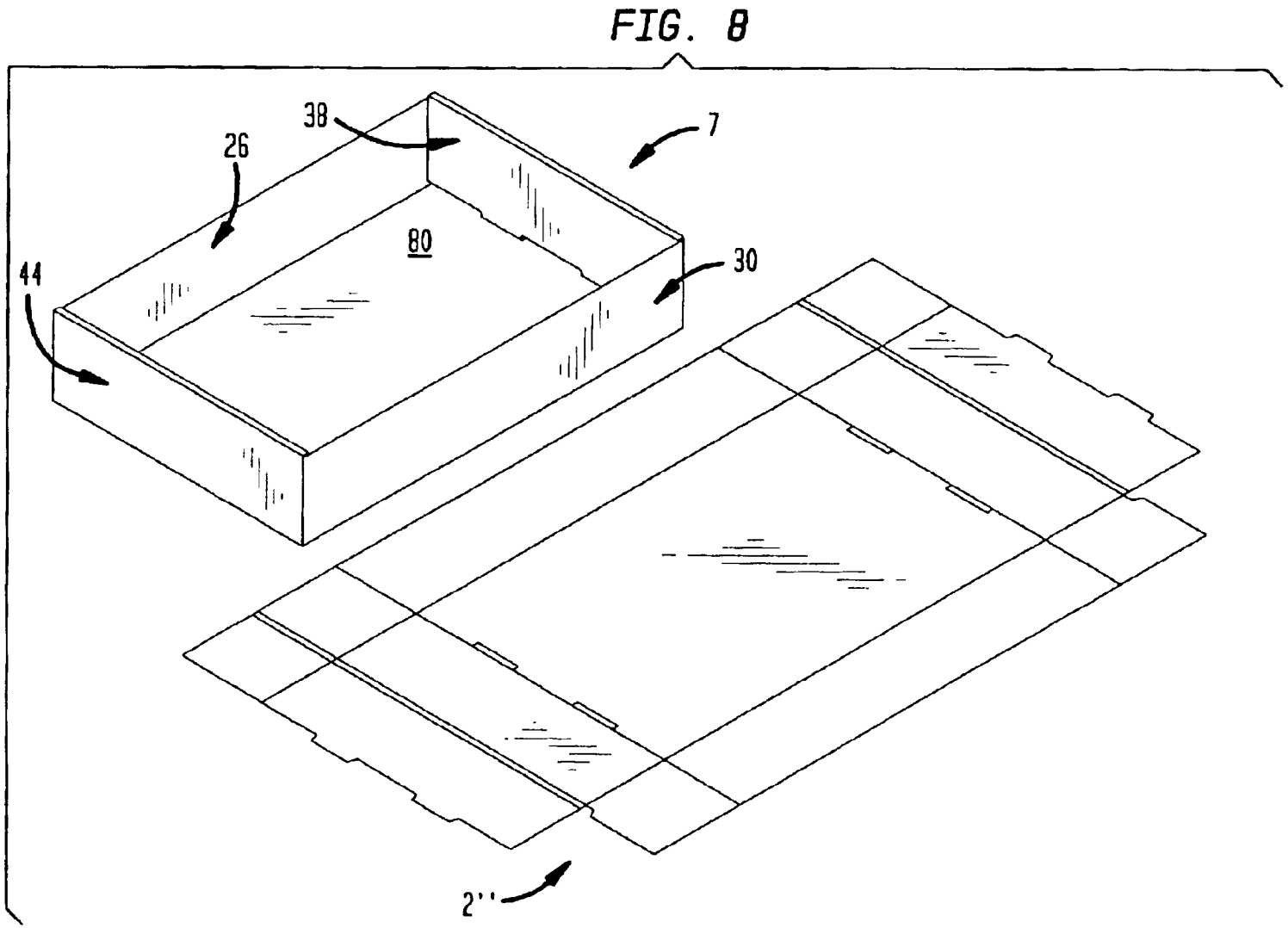

In the boundary defined by vertical fold lines 8 and 10 and horizontal fold lines 20 and 22, lies small panel 80. Small panel 80 constitutes the floor of a packaging structure 7 which results from folding blank 2' as shown in FIGS. 6–8.

Figure 6:
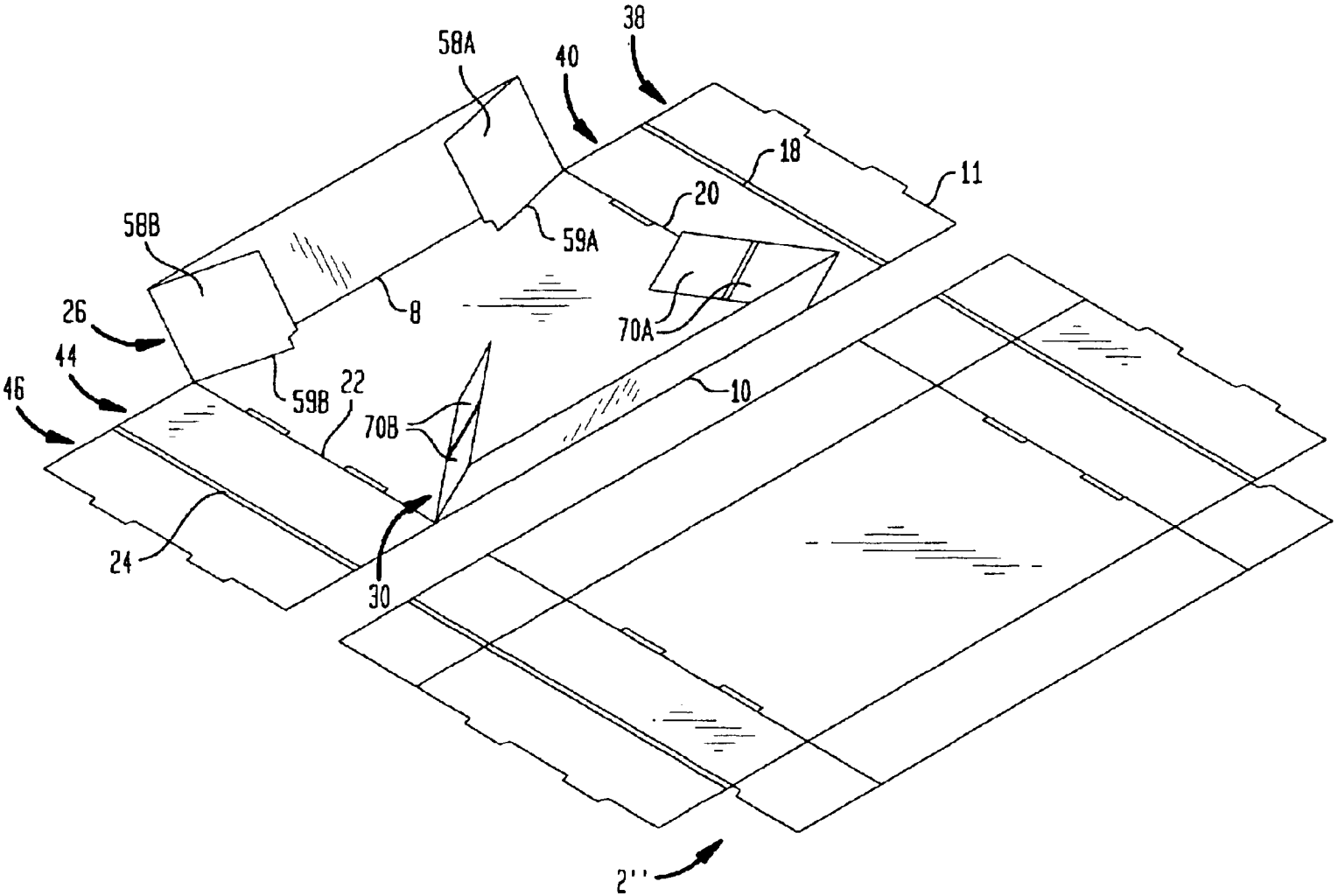
FIGS. 6–8 are perspective views showing a technique for folding one of the separate blanks of FIG. 5 into a packaging structure.

As a first step, blank 2' may be placed in the intermediate folded position shown in FIG. 6. This is accomplished by first breaking score lines 59A and 59B to create flaps 58A and 58B, as previously described.

Vertical fold line 10 is then cut from continuous border 11 to horizontal fold line 20 and from continuous border 11 to horizontal fold line 22 to create flaps 70A and 70B, respectively. It will be appreciated that the effort used to cut vertical fold line 10 may be greater than that to cut score lines 59A and 59B. This is because score lines 59A and 59B may be weakened to a greater extent than vertical fold line 10. It also will be appreciated that flaps 70A and 70B are longer than flaps 58A and 58B, as they include portions of horizontal folding panels 38 and 46, respectively.

Flaps 58A and 70A are then folded upwardly along horizontal fold line 20, and flaps 58B and 70B are folded upwardly along horizontal fold line 22. Thereafter, vertical folding panels 26 and 30 are folded upwardly along vertical fold lines 8 and 10, respectively, as shown in FIG. 6. As shown in FIG. 7, horizontal folding panels 38 and 40 are then folded in tandem upwardly along horizontal fold line 20 such that flaps 58A and 70A lie interior of horizontal folding panel 40. Horizontal folding panel 38 may then be folded along fold line 18 over flaps 58A and 70A such that these flaps are interposed between horizontal folding panels 38 and 40. If the continuous border 11 is provided with tab members 50 and horizontal fold line 20 is provided with slots 52, then the tab members are inserted into the slots to retain the packaging structure in this subsequent folded condition. It will be appreciated that when placing the packaging structure 7 in such a configuration, vertical folding panels 26 and 30 necessarily will be retained in a position nearly perpendicular to the plane of panel 80.

To complete formation of packaging structure 7, horizontal folding panels 44 and 46 are folded over flaps 58B and 70B in a manner similar to that used to fold horizontal folding panels 38 and 40, so that flaps 58B and 70B are interposed between horizontal folding panels 44 and 46. Subsequently, if the continuous border 11 is provided with tab members 50 and horizontal fold line 22 is provided with corresponding slots 52, the tab members 50 are inserted into the slots to retain the packaging structure 7 in this finished condition. FIG. 8 depicts a completed small package structure 7 formed in accordance with this procedure. It will be appreciated that a second small packaging structure 7 may be constructed from blank 2" in much the same manner.

Although it has been shown that the panels 80 of packaging structures 7 are about the same size, it will be appreciated that one panel may be larger than the other. In such case, the packaging structure 7 formed from blank 2' will be a different size than the packaging structure 7 formed from blank 2".

Figure 9:
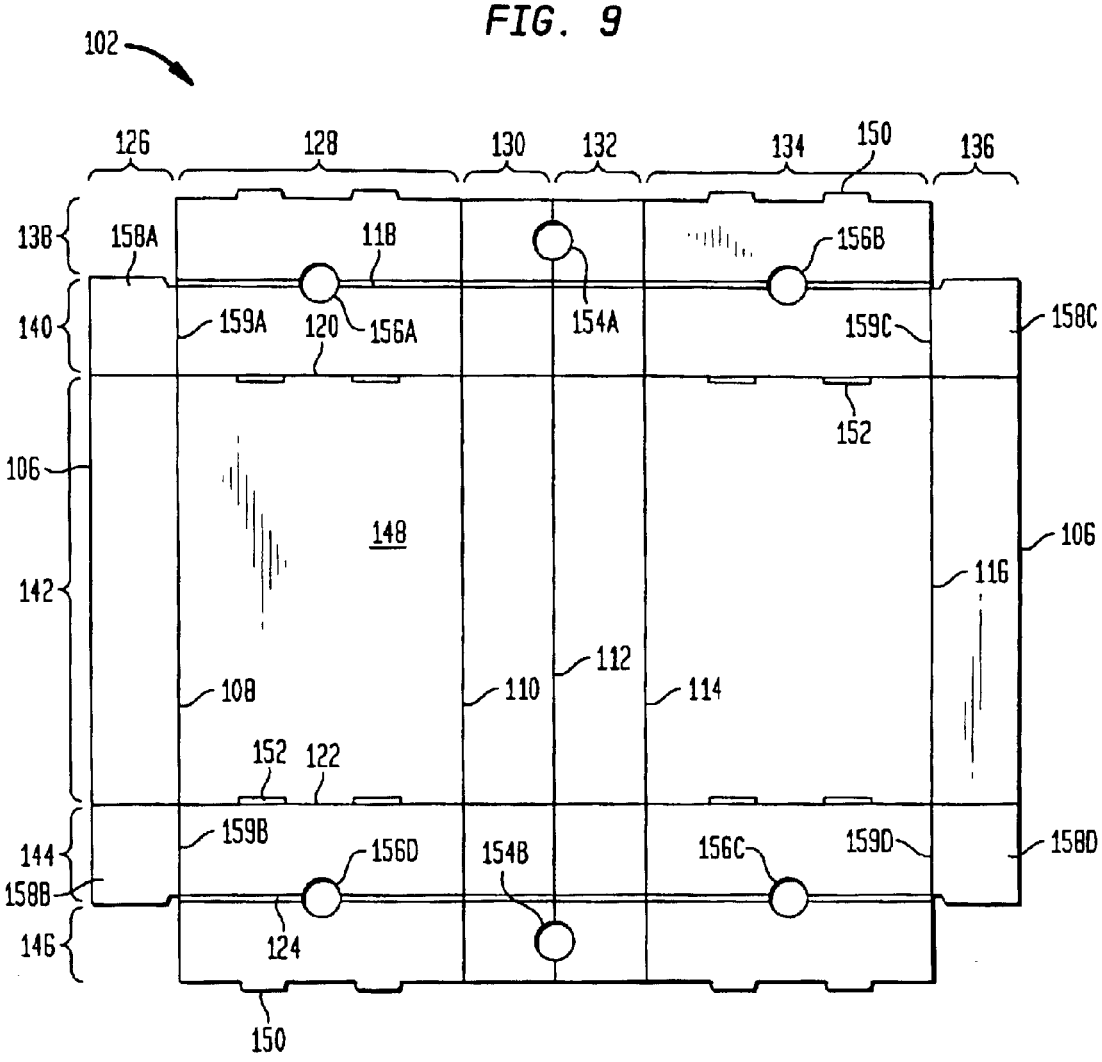
FIG. 9 is a plan view of a blank for forming a cover for the packaging structures of the present invention.

FIG. 9 is a plan view of a blank 102 for forming covers for the packaging structures which may be formed from blank 2. Blank 102 includes a continuous border 106 completely circumscribing its periphery. When positioned in the orientation shown in FIG. 9, blank 102 further includes substantially parallel vertical fold lines 108, 110, 112, 114 and 116, and substantially parallel horizontal fold lines 118, 120, 122 and 124. The vertical fold lines 108, 110, 112, 114 and 116 preferably are perpendicular to the horizontal fold lines 118, 120, 122 and 124.

Each of the fold lines 108, 110, 112, 114, 116, 120 and 122 are single fold lines. Fold lines 118 and 124, however, are double fold lines. As previously described, single fold lines are typically utilized to make a fold of approximately 90 degrees while double fold lines are used when the fold is approximately 180 degrees.

Fold lines 108, 110, 112, 114 and 116 and continuous border 106 of blank 102 define vertical folding panels 126, 128, 130, 132, 134 and 136. As shown in FIG. 9, vertical folding panel 126 lies between portions of continuous border 106 and vertical fold line 108; vertical folding panel 128 lies between vertical fold lines 108 and 110; vertical folding panel 130 lies between vertical fold lines 110 and 112; vertical folding panel 132 lies between vertical fold lines 112 and 114; vertical folding panel 134 lies between vertical fold lines 114 and 116; and vertical folding panel 136 lies between vertical fold line 116 and portions of continuous border 106.

Vertical folding panel 126 has a pair of flaps 158A and 158B formed at its extremities. Flap 158A is defined by score line 159A formed substantially, but not entirely, through the thickness of blank 102, while flap 158B is defined by a score line 159B formed substantially, but not entirely, through the thickness of blank 102. Vertical folding panel 136 includes similar flaps 158C and 158D formed at its extremities, flap 158C being defined by score line 159C and flap 158D being defined by score line 159D. Both score lines 159C and 159D are formed substantially, but not entirely, through the thickness of blank 102. In a preferred embodiment, score lines 159A–D remain connected during all phases of processing, packaging and transporting of blank 102. These score lines may be intentionally broken by the user with little effort, such that flaps 158A–D are free to rotate independently of the portion of blank 102 to which they formerly were attached.

Blank 102 further includes horizontal folding panels 138, 140, 142, 144 and 146. As shown in FIG. 9, horizontal folding panel 138 lies between a portion of continuous border 106 and horizontal fold line 118; horizontal folding panel 140 lies between horizontal fold lines 118 and 120; horizontal folding panel 142 lies between horizontal fold lines 120 and 122; horizontal folding panel 144 lies between horizontal fold lines 122 and 124; and horizontal folding panel 146 lies between horizontal fold line 124 and portions of continuous border 106.

Figure 10:
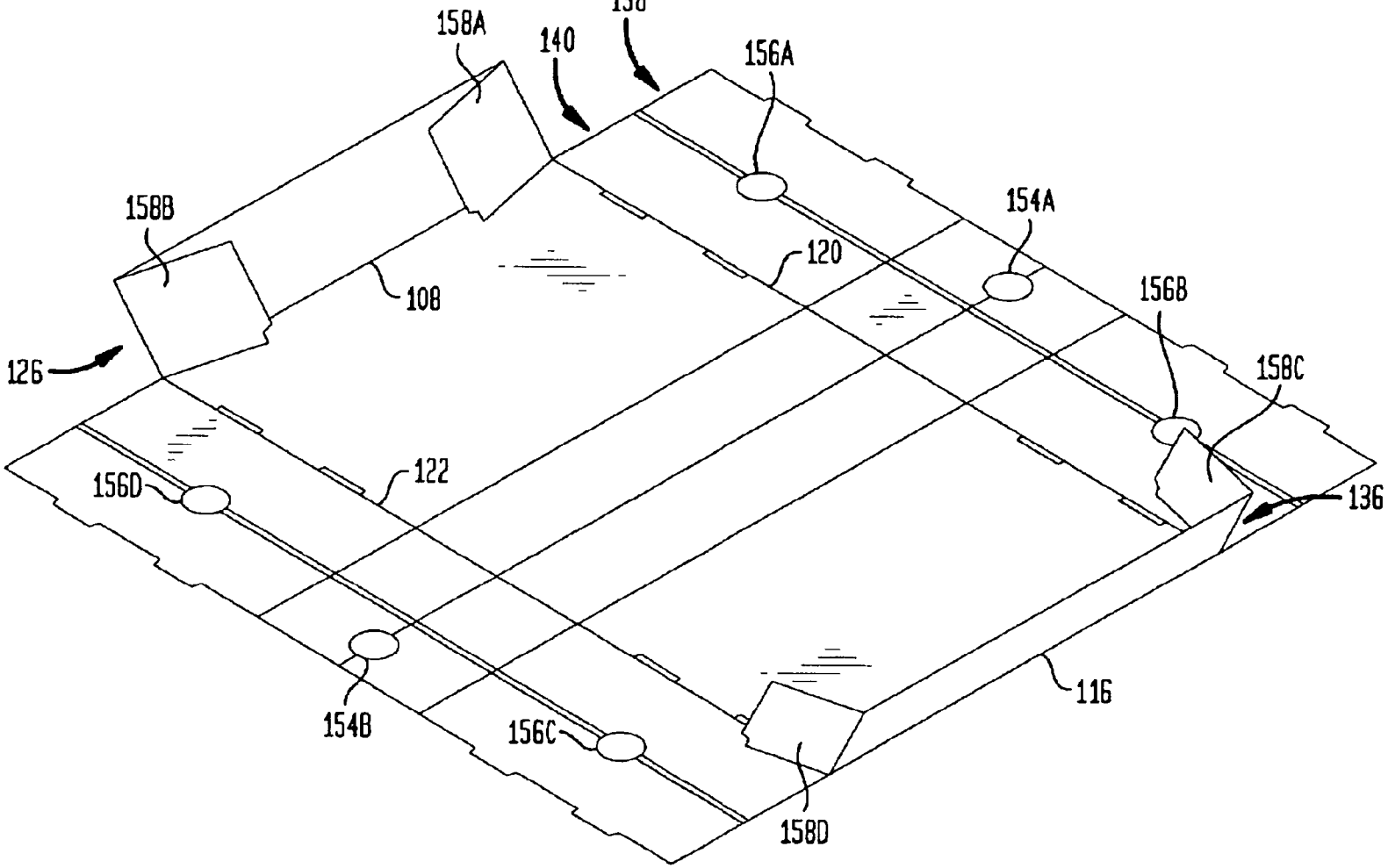
FIGS. 10–12 are perspective views showing a technique for folding the blank of FIG. 9 into a cover for the packaging structure of FIGS. 1–4.
Figure 11:
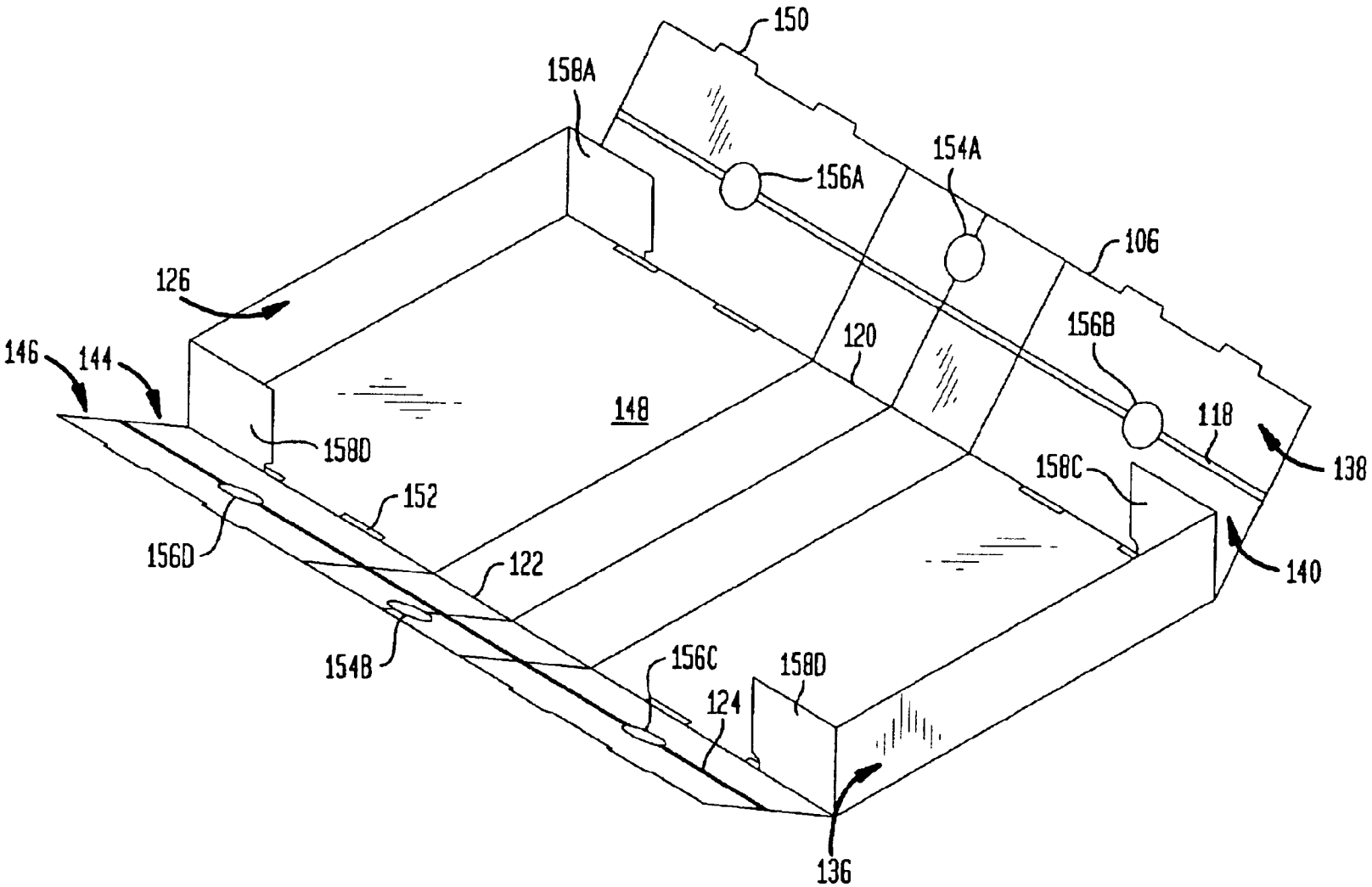
Figure 12:
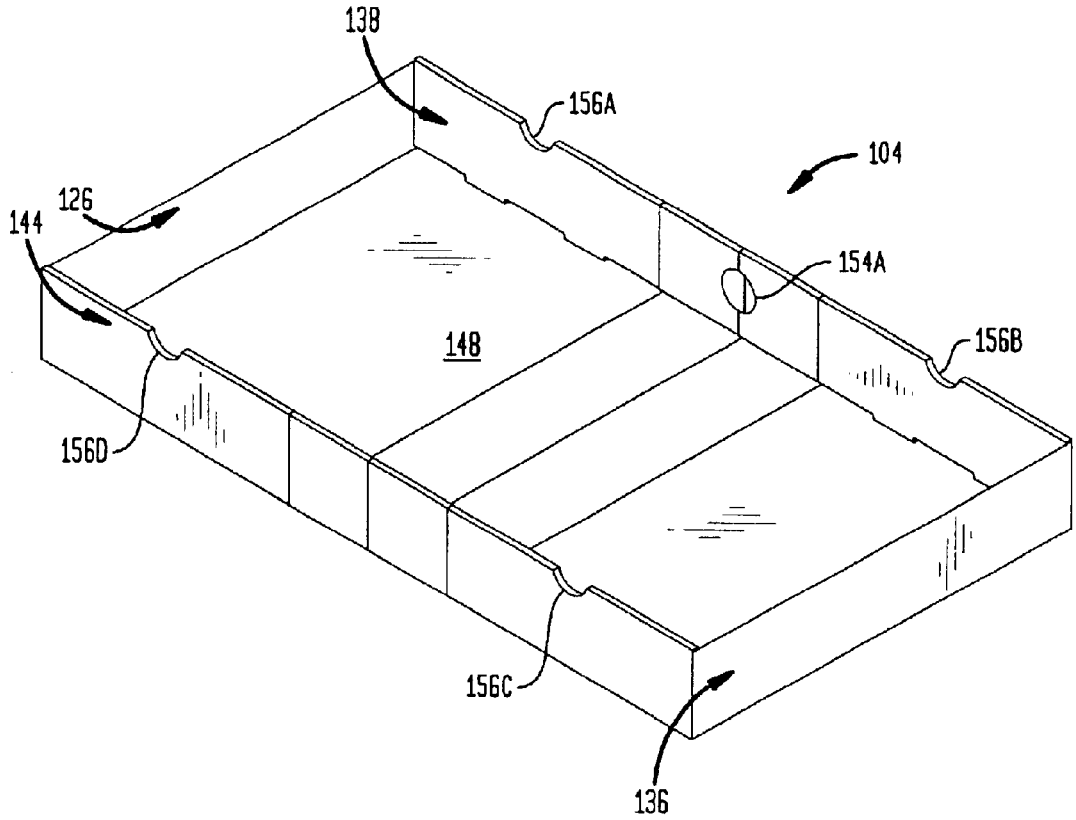

In the boundary defined by vertical fold lines 108 and 116 and horizontal fold lines 120 and 122, lies large panel 148. Large panel 148 constitutes the top of a cover folded as shown in FIGS. 10–12. As will be appreciated from the explanation of the procedure depicted in FIGS. 10–12, vertical fold lines 110, 112 and 114 are not folded in this procedure.

Along the continuous border 106 and protruding therefrom, there are included tab members 150 in preferred embodiments of the present invention. In addition, if tab members 150 are included, fold lines 120 and 122 will include corresponding slots 152 for receiving the tab members 150 when the covers formable from blank 102 are fully folded. The interlocking of the tab members 150 within the slots 152 assists in maintaining the structural rigidity and folded condition of the covers.

In preferred embodiments, an aperture may be defined in each of horizontal folding panels 138 and 146. Horizontal folding panel 138 may include an aperture 154A centrally located therein, while horizontal folding panel 146 may include an aperture 154B centrally located therein. As a result of their central positions, each of these apertures is bisected by vertical fold line 112.

In addition, blank 102 may include further apertures defining cutouts when blank 102 is fully folded into a cover as described below. In all, there is typically four such cutouts 156A–D. The first cutout 156A is centrally located between vertical fold lines 108 and 110 on horizontal fold line 118. In this location, the cutout 156A is bisected by horizontal fold line 118, and has substantially equal portions located within horizontal folding panels 138 and 140. The second cutout 156B is centrally located between vertical fold lines 114 and 116 on horizontal fold line 118. As with cutout 156A, this cutout 156B is bisected by horizontal fold line 118, and has substantially equal parts within horizontal folding panels 138 and 140. The third cutout 156C is centrally located between vertical fold lines 114 and 116 on horizontal fold line 124. In this location, cutout 156C is bisected by horizontal fold line 124, and has substantially equal parts located within horizontal folding members 144 and 146. The fourth cutout 156D is centrally located between vertical fold lines 108 and 110 on horizontal fold line 124. As with the third cutout 156C, this cutout 156D is bisected by horizontal fold line 124, and has substantially equal parts within horizontal folding members 144 and 146. It will be appreciated that the purpose of these cutouts 156A–D is to provide areas where leverage may be obtained on the finished cover by the digits of the human hand, as described hereinafter.

In one method depicted in FIGS. 10–12, blank 102 may be folded to form a single large cover 104. As a first step, blank 102 may be placed in the intermediate folded position shown in FIG. 10. This is accomplished by first folding flaps 158A and 158C upwardly along fold line 120 and by folding flaps 158B and 158D upwardly along fold line 122. Thereafter, vertical folding panels 126 and 136 are folded upwardly along vertical folding lines 108 and 116, respectively. As shown in FIG. 11, horizontal folding panels 138 and 140 are then folded in tandem upwardly along horizontal fold line 120 such that flaps 158A and 158C lie interior of horizontal folding panel 140. Horizontal folding panel 138 is then folded over flaps 158A and 158C such that these flaps are interposed between horizontal folding panels 138 and 140. If the continuous border 106 is provided with tab members 150 and horizontal fold line 120 is provided with slots 152, then the tab members 150 are inserted into the slots 152 to retain the cover 104 in this subsequent folded condition. It will be appreciated that when placing the cover 104 in such a configuration, vertical folding panels 126 and 136 necessarily will be retained in a position nearly perpendicular to the plane of panel 148.

Finally, to complete formation of cover 104, horizontal folding panels 144 and 146 are folded over flaps 158B and 158D, first by folding along fold line 122 and then by folding along fold line 124, such that flaps 158B and 158D are interposed between horizontal folding panels 144 and 146. Following this procedure, if the continuous border 106 is provided with tab members 150 and horizontal fold line 122 is provided with corresponding slots 152, the tab members 150 are positioned within the slots 152 to retain the cover 104 in this finished condition. A packaging cover 104 folded in accordance with this procedure is shown in FIG. 12.

Figure 13:
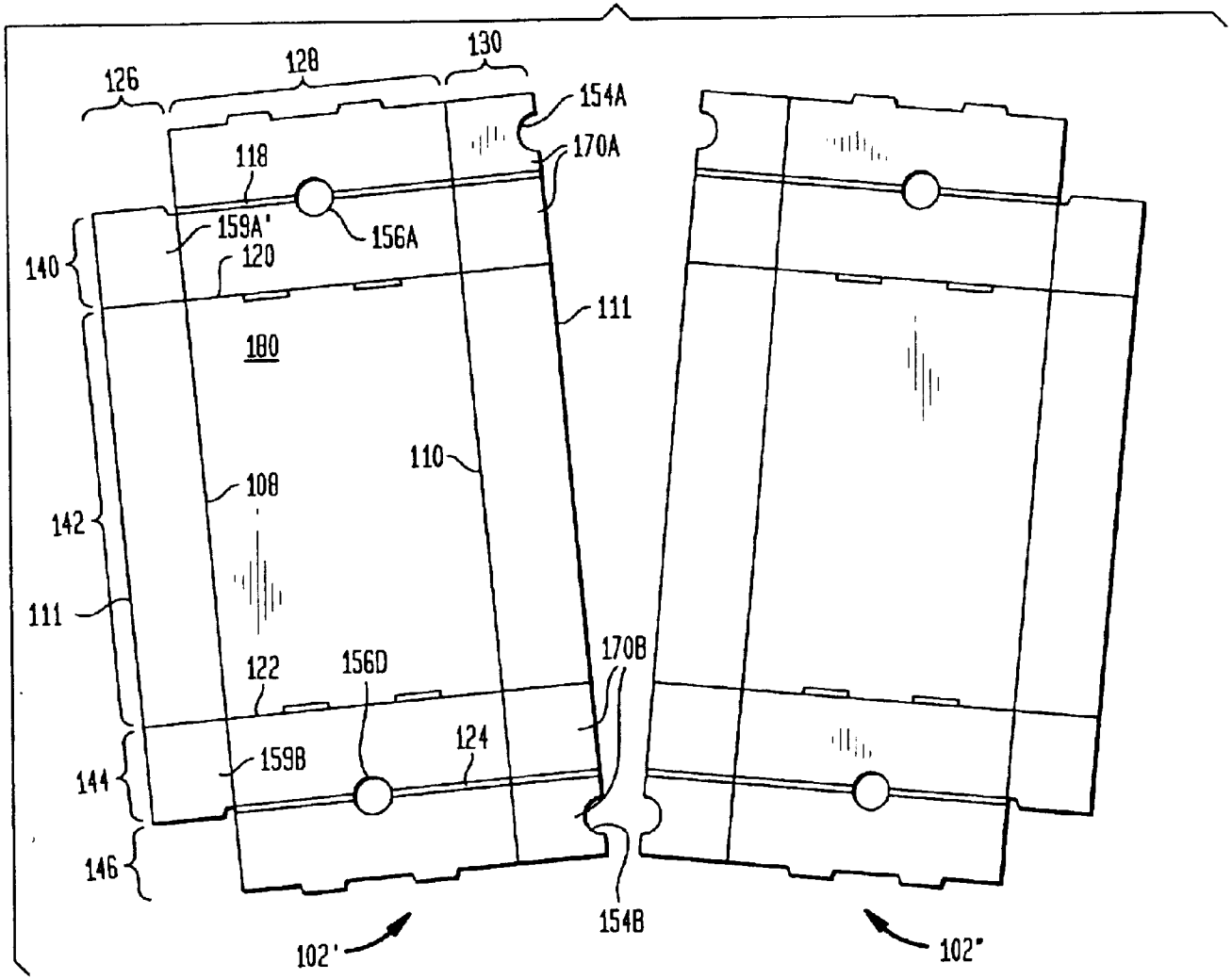
FIG. 13 is a plan view showing the separation of the blank of FIG. 9 into two separate blanks.

Rather than folding blank 102 to form a single large cover 104 as described above, blank 102 may be torn, cut or otherwise separated along fold line 112 into two minor blanks 102' and 102", as shown in FIG. 13. The end result of this separation is that blank 102 may be used to form two smaller covers 107. Using minor blank 102' as an example, the following detailed description illustrates the structure of minor blank 102' and its formation into a cover 107 which is smaller than cover 104.

Blank 102' includes a continuous border 111 completely circumscribing its periphery. Border 111 is defined by portions of border 106 and fold line 112 of blank 102. When positioned in the orientation shown in FIG. 13, blank 102' further includes vertical fold lines 108 and 110, and horizontal fold lines 118, 120, 122 and 124.

As previously described, each of the vertical fold lines 108 and 110 are single fold lines, as are horizontal fold lines 120 and 122. Horizontal fold lines 118 and 124, meanwhile, are double fold lines. As shown in FIG. 13, these fold lines define in blank 102' vertical folding panels 126, 128 and 130, and horizontal folding panels 138, 140, 142, 144 and 146.

Vertical folding panel 126 has flaps 158A and 158B formed at its extremities. Vertical folding panel 130, on the other hand, has a pair of flaps 170A and 170B which must be created by the end user. The process of creating such flaps will be described hereinafter.

In the boundary defined by vertical fold lines 108 and 110 and horizontal fold lines 120 and 122, lies small panel 180. Small panel 180 constitutes the top of a cover 107 constructed in accordance with the embodiment shown in FIGS. 13–16.

Figure 14:
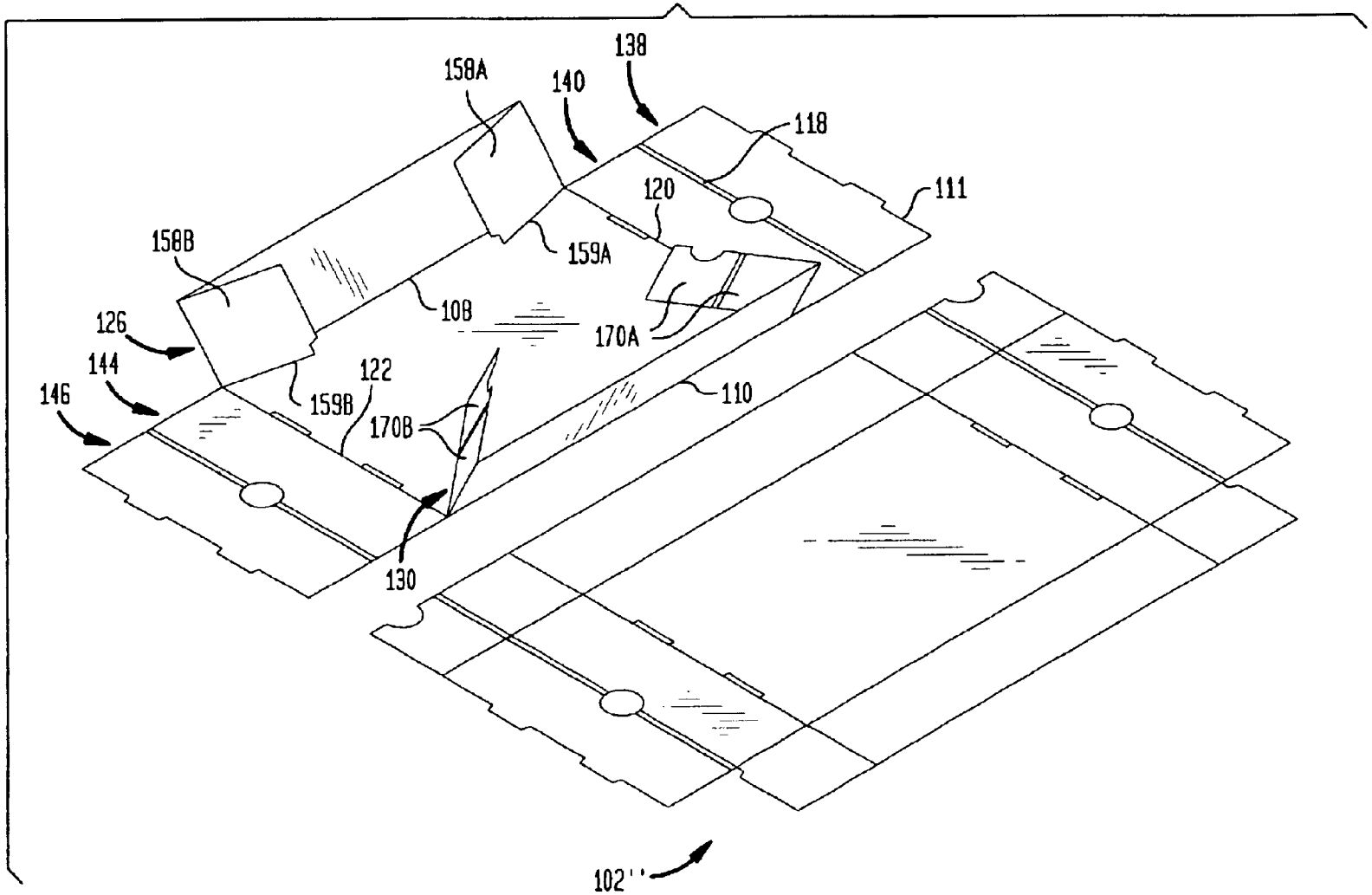
FIGS. 14–16 are perspective views showing a technique for folding one of the separate blanks of FIG. 13 into a cover for the packaging structure of FIGS. 5–8.

As a first step, blank 102' may be placed in the intermediate folded position shown in FIG. 14. This is accomplished by first breaking score lines 159A and 159B to create flaps 158A and 158B, as has been previously described.

Vertical fold line 110 is then cut from continuous border 111 to horizontal fold line 120 and from continuous border 111 to horizontal fold line 122 to create flaps 170A and 170B, respectively. It will be appreciated that the effort used to cut vertical fold line 110 may be greater than that to cut score lines 159A and 159B. This is because score lines 159A and 159B may be weakened to a greater extent than vertical fold line 110. It also will be appreciated that flaps 170A and 170B are longer, respectively, than flaps 158A and 158B derived from vertical folding member 126.

Flaps 158A and 170A are then folded upwardly along horizontal fold line 120, and flaps 158B and 170B are folded upwardly along horizontal fold line 122. Thereafter, vertical folding panels 126 and 130 are folded upwardly along vertical fold lines 108 and 110, respectively, as shown in FIG. 14. Horizontal folding panels 138 and 140 are then folded in tandem upwardly along horizontal fold line 120 such that flaps 158A and 170A lie interior of horizontal folding panel 140.

Figure 15:
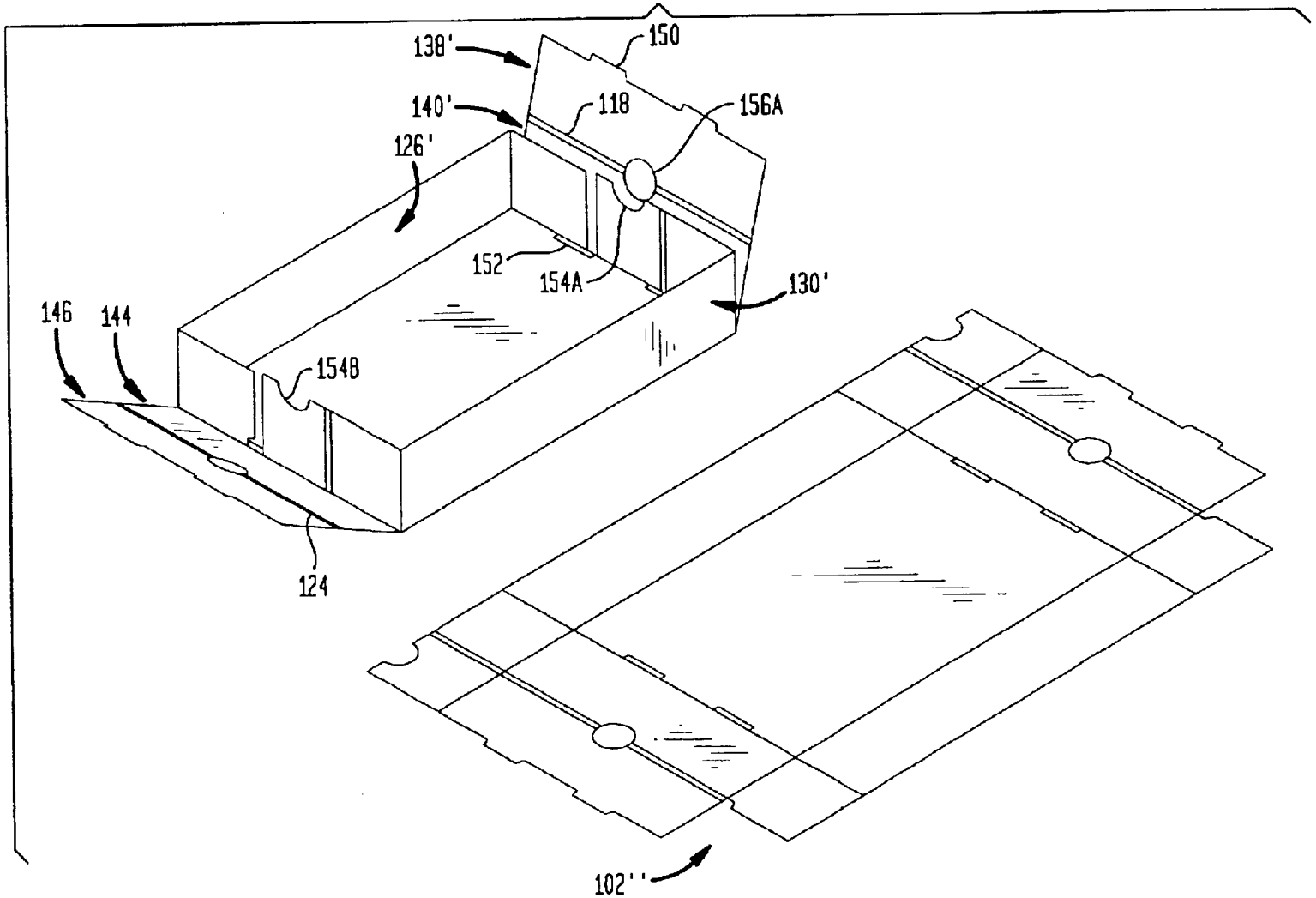

As shown in FIG. 15, horizontal folding panel 138 may then be folded along fold line 118 over flaps 158A and 170A such that these flaps are interposed between horizontal folding panels 138 and 140. It will be appreciated that the portion of aperture 154A remaining in blank 102' aligns with cutout 156A when the cover 107 is placed in such a position. If the continuous border 111 is provided with tab members 150 and horizontal fold line 120 is provided with slots 152, then the tab members 150 are inserted into the slots 152 to retain the cover in this subsequent folded condition. It will be appreciated that when placing the blank 102' in such a configuration, vertical folding panels 126 and 130 necessarily will be retained in a position nearly perpendicular to the plane of panel 180.

Figure 16:
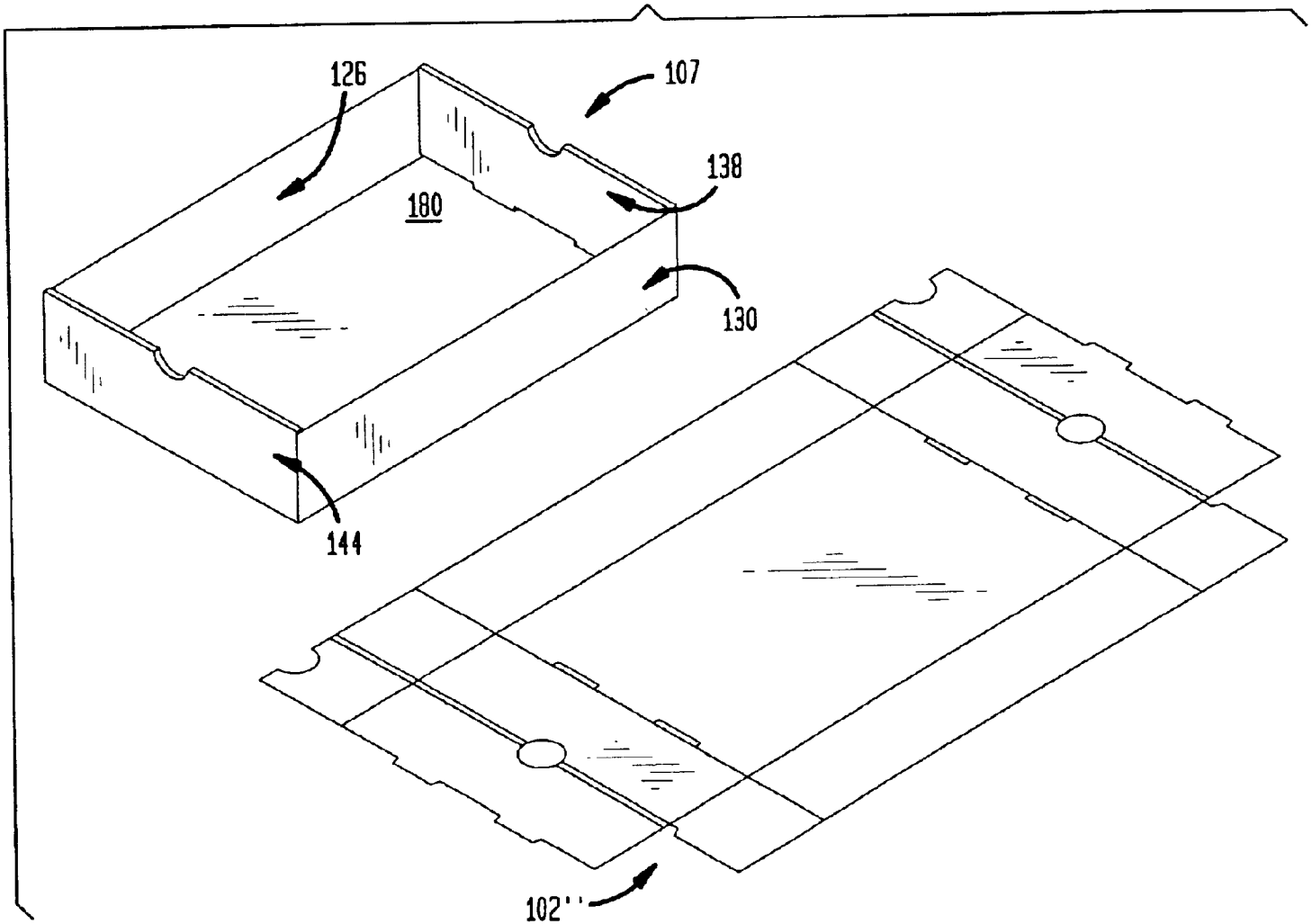

To complete formation of cover 107, horizontal folding panels 144 and 146 are folded over flaps 158B and 170B in a manner similar to that used to fold horizontal folding panels 138 and 140, so that flaps 158B and 170B are interposed between horizontal folding panels 144 and 146. It will be appreciated that the portion of aperture 154B remaining in blank 102' aligns with cutout 156D when blank 102' is placed in such a position. Subsequently, if the continuous border 111 is provided with tab members 150 and horizontal fold line 122 is provided with corresponding slots 152, the tab members 150 are positioned within the slots 152 to retain the cover 107 in this finished condition. FIG. 16 depicts a completed cover 107 formed in accordance with this procedure. It will be appreciated that a second cover 107 may be constructed from blank 102" in much the same manner.

As with panel 80 of packaging structure 7, although it has been shown that the panels 180 of packaging structures 107 are all about the same size, it will be appreciated that one panel may be larger than the other. In such event, the packaging structure 107 formed from blank 102' will be a different size than the packaging structure 107 formed from blank 102".

Figure 17:
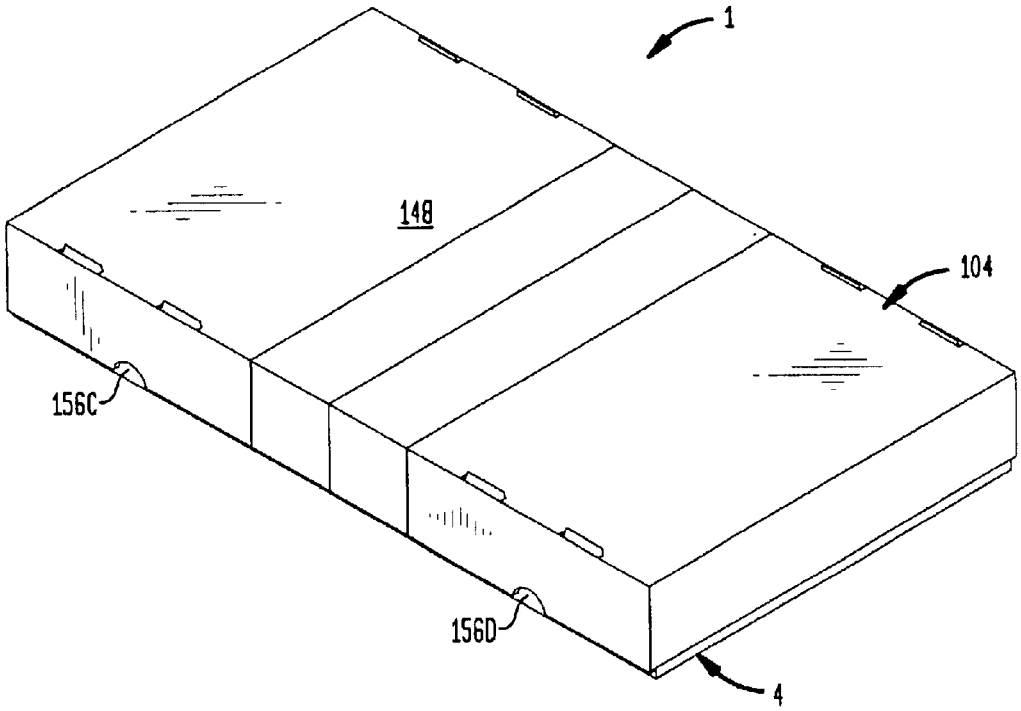
FIG. 17 is a perspective view of the completed packaging structure of FIGS. 1–4 with cover.

Upon completion of the packaging structure 4 as shown in FIG. 4, and completion of the cover 104, as shown in FIG. 12, a completed box 1 may be formed by placing the cover 104 over the packaging structure 4 such that the interior portions of each are facing each other with sides of corresponding length aligned with one another. It will be appreciated that the dimensions of panel 148 are slightly larger than the dimensions of panel 48. Typically, the dimensions differ by about 2–6 times the thickness of the packaging structure blank 2. This enables cover 104 to nestle upon packaging structure 4 in the configuration shown by FIG. 17. Cutouts 156A–D enable an end user to easily remove the cover 104 from the packaging structure 4 by providing a location where leverage may be obtained upon the cover 104.

Figure 18:
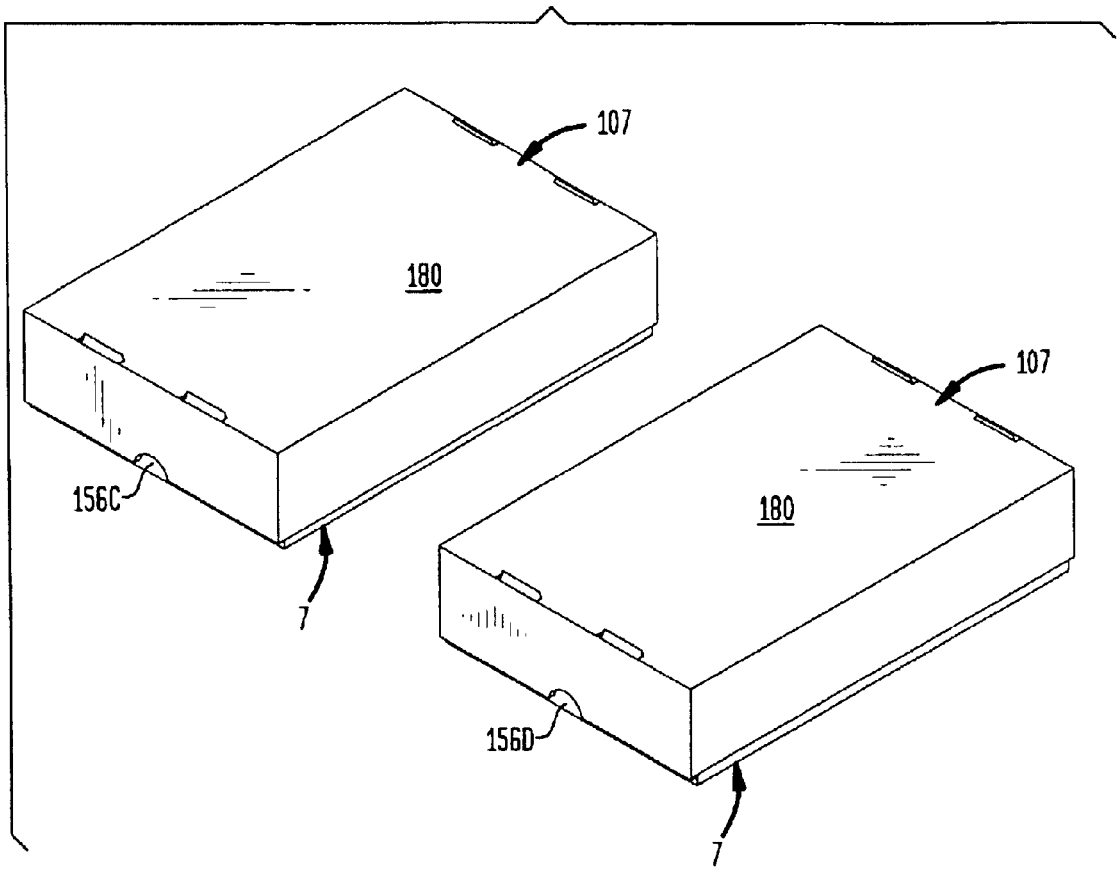
FIG. 18 is a perspective view of two completed packing structures of FIGS. 5–8 with covers.

Similarly, FIG. 18 shows two completed boxes formed when blanks 2 and 102 are split to form two separate packing structures and two separate covers. Each panel 180 is slightly larger than its corresponding panel 80 to enable each cover 107 to nestle upon the corresponding packaging structure 7 in the configuration shown by FIG. 18.

Although the cover previously described is the preferred cover, various other covers may be employed to serve the same function. Such covers include simple flat panels made of various materials such as cardboard or plastic, or pliable materials such as canvass or plastic wrap, or any other item which serves to protect the object placed within the packaging structure.

Figure 19:
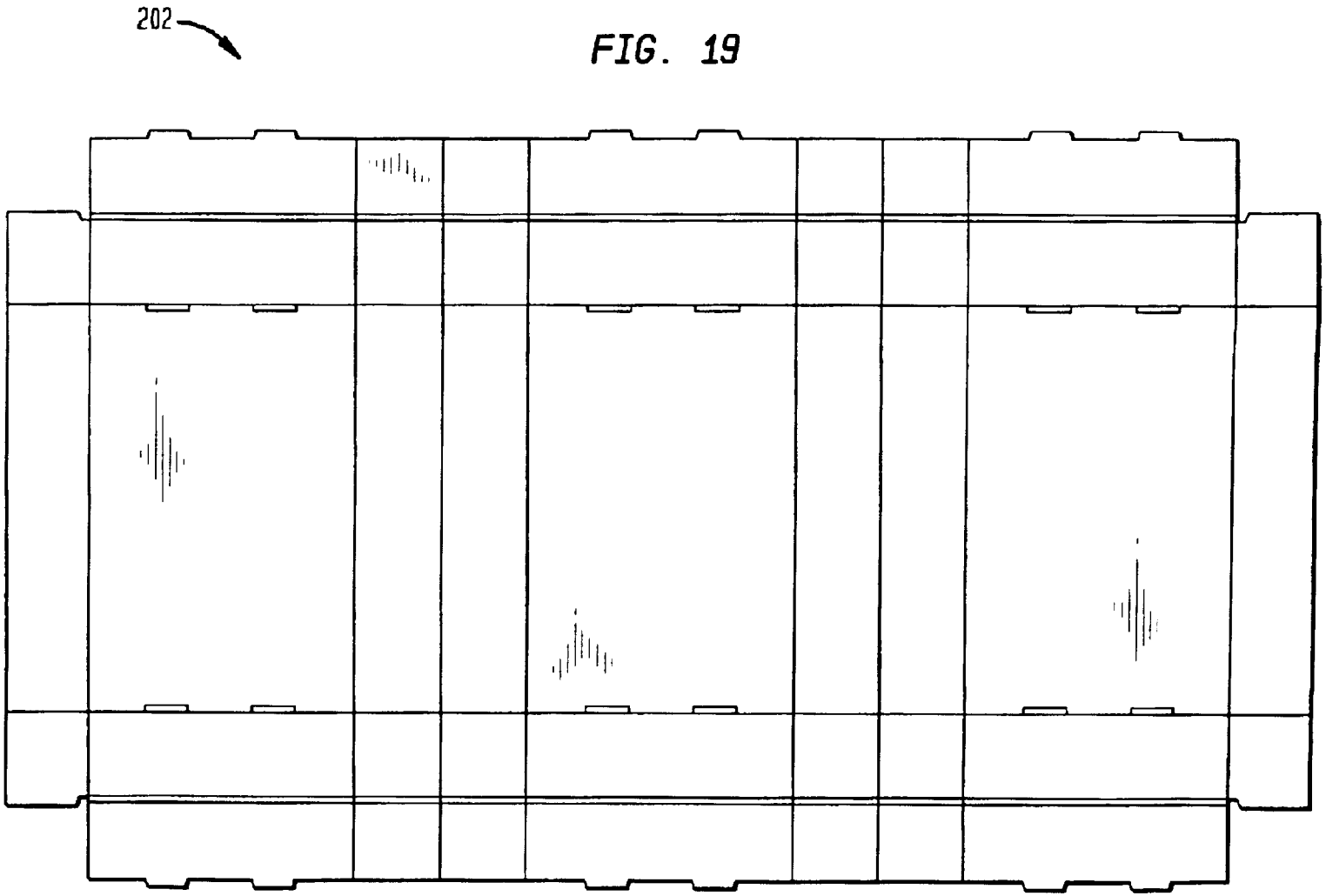
FIG. 19 is a plan view of a blank for forming a packaging structure in accordance with a second embodiment of the present invention.

FIG. 19 is a plan view of a blank 202 for forming either a single packaging structure, two packaging structures, or three packaging structures in accordance with a second embodiment of the present invention. As with the previous blanks, blank 202 may be folded as shown, or may be separated along fold lines into smaller blanks. If folded as shown, blank 202 will create a single large packaging structure. Alternatively, blank 202 may be split in thirds and folded into three smaller packaging structures of about the same size. It will be appreciated that other intermediate size packaging structures may also be formed. Blank 202 may also be split into a small blank about one-third the size of blank 202, and a medium blank about two-thirds the size of blank 202. Folding of these blanks is conducted in a manner similar to that described for the other embodiments of the present invention. Although not shown, it will be appreciated that another blank may be provided for forming covers for the one, two or three packaging structures formed from blank 202. Formation of these covers is conducted in substantially the same manner as previously described.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims. In this regard, it is to be understood that although 2 in 1 and 3 in 1 packaging structures and associated covers have been explicitly detailed, it is the intention of this disclosure to cover all such combinations of packaging structures and covers wherein a single blank may be manipulated in the manner described into multiple package structures and covers, including 4 in 1, 5 in 1, 6 in 1, etc.

What is claimed is:

1. A blank for forming packages, comprising:

a substantially rigid panel having a pair of spaced side edges and a pair of spaced end edges oriented transverse to said side edges;

a first pair of fold lines spaced from said side edges of said panel to define respective folding side portions separated by a remaining portion of said panel;

a second pair of fold lines spaced from said end edges of said panel and oriented transverse to said first pair of fold lines, said second pair of fold lines defining respective folding end portions, said first and second pairs of fold lines delimiting a center portion of said panel;

a pair of auxiliary fold lines extending between said end edges in said remaining portion of said panel and oriented transverse to said second pair of fold lines; and an intermediate fold line extending between said end edges in said remaining portion of said panel and oriented transverse to said second pair of fold lines, said intermediate fold line being disposed between said pair of auxiliary fold lines to define a first auxiliary folding portion between one of said pair of auxiliary fold lines and said intermediate fold line and a second auxiliary folding portion between another of said pair of auxiliary fold lines and said intermediate fold line;

said panel having an unfolded condition in which said folding side portions and said folding end portions are substantially coplanar with said center portion;

said panel having a second condition in which said folding side portions and said folding end portions are folded transverse to said center portion of said panel to define a first packaging structure;

said panel having a third condition in which said panel is separated along said intermediate fold line into two subpanels, each said subpanel having one of said folding side portions, one of said auxiliary folding portions and said folding end portions delimiting a main portion of said subpanel, each of said subpanels being foldable into a condition in which said one folding side portion, said one auxiliary folding portion and said folding end portions are folded transverse to said main portion of said subpanel, whereby said panel in said third condition defines a pair of packaging structures;

said blank further comprising a first additional fold line in each of said folding end portions defining proximal and distal end segments in each of said folding end portions, each of said folding end portions in said second condition of said panel being folded along said first additional fold lines so that said distal end segment in each of said folding end portions confronts said proximal end segment and is positioned between said folding side portions.

2. The blank for forming packages as claimed in claim 1, further comprising means for interconnecting said folding side portions and said folding end portions in said second condition of said panel.

3. The blank for forming packages as claimed in claim 2, wherein said interconnecting means includes a flap formed at each end of each of said folding side portions and foldable relative to said folding side portions, said flaps being interposed between said proximal end segment and said distal end segment of said folding end portions when said panel is in said second condition.

4. The blank for forming packages as claimed in claim 3, wherein said flaps are joined to said folding side portions and said folding end portions in said unfolded condition of said panel, but are not joined to said folding end portions in said second condition of said panel.

5. The blank for forming packages as claimed in claim 1, further comprising means for interconnecting said folding side portions and said folding auxiliary portions with said folding end portions in said third condition of said panel.

6. The blank for forming packages as claimed in claim 5, wherein said interconnecting means includes a flap formed at each end of each of said folding side portions and a flap formed at each end of each of said auxiliary folding portions, said flaps being interposed between said proximal end segments and said distal end segments of said folding end portions when said panel is in said third condition.

7. The blank for forming packages as claimed in claim 6, wherein said flaps are joined to said folding side portions, said auxiliary folding portions and said folding end portions in said unfolded condition of said panel, but are not joined to said folding end portions in said third condition of said panel.

8. The blank for forming packages as claimed in claim 1, further comprising means for securing said panel in said second condition.

9. The blank for forming packages as claimed in claim 8, wherein said securing means includes a patterned cut in each of said folding end portions defining at least one tab in each of said folding end portions, each said tab projecting from one of said end edges in a direction away from said center portion of said panel; and at least one slot formed along each of said second pair of fold lines, wherein each said tab is engageable in one of said slots when said panel is in said second condition.

* * * * *